US006986630B2

(12) United States Patent
Marsh

(10) Patent No.: US 6,986,630 B2
(45) Date of Patent: Jan. 17, 2006

(54) PERFECT BOUND BOOK HAVING A DOUBLE LAMINATED COVER AND METHOD OF AND APPARATUS FOR MANUFACTURING SAME

(76) Inventor: Jeffrey D. Marsh, 7 Country Rd., Foristell, MO (US) 63348

( * ) Notice: Subject to any disclaimer, the term of this patent is extended or adjusted under 35 U.S.C. 154(b) by 322 days.

(21) Appl. No.: 10/017,185

(22) Filed: Dec. 7, 2001

(65) Prior Publication Data

US 2002/0064436 A1 May 30, 2002

(51) Int. Cl.
*B42C 9/00* (2006.01)

(52) U.S. Cl. ..... 412/1; 281/38; 156/153; 156/154; 156/257; 156/556; 156/566; 156/567; 156/908; 412/4; 412/5; 412/6; 412/8; 412/33

(58) Field of Classification Search ..... 412/1, 412/4, 5, 6, 8, 33; 156/153, 154, 257, 556, 156/566, 567, 908; 281/38
See application file for complete search history.

(56) References Cited

U.S. PATENT DOCUMENTS

| | | | | |
|---|---|---|---|---|
| 3,093,396 A | | 6/1963 | Segreto | |
| 3,575,501 A | | 4/1971 | Rosenberg | |
| 3,749,423 A | * | 7/1973 | Abildgaard et al. | 281/21.1 |
| 3,884,742 A | * | 5/1975 | Roberts | 156/268 |
| 3,888,150 A | | 6/1975 | Stroud et al. | |
| 3,953,056 A | * | 4/1976 | Roberts | 281/29 |
| 3,982,744 A | | 9/1976 | Kraynak et al. | |
| 4,147,380 A | * | 4/1979 | Nelson | 281/29 |
| 4,184,218 A | * | 1/1980 | Hawkes | 412/8 |
| 4,502,223 A | | 3/1985 | Brookfield | |
| 4,528,643 A | | 7/1985 | Freeny, Jr. | |
| 4,839,829 A | | 6/1989 | Freedman | |
| 5,213,461 A | | 5/1993 | Kalisher | |
| 5,240,362 A | | 8/1993 | Nakayama et al. | |
| 5,295,775 A | | 3/1994 | Andjelic et al. | |
| 5,340,155 A | * | 8/1994 | Podosek | 281/29 |
| 5,465,213 A | | 11/1995 | Ross | |
| 5,499,847 A | | 3/1996 | Smith | |
| 5,547,176 A | | 8/1996 | Williams et al. | |
| 5,662,448 A | * | 9/1997 | Graushar et al. | 412/4 |
| 5,724,075 A | | 3/1998 | Smith | |
| 5,779,423 A | | 7/1998 | Bermingham | |
| 5,868,539 A | | 2/1999 | Rathert | |
| 5,871,323 A | * | 2/1999 | Clark | 412/4 |
| 6,012,367 A | | 1/2000 | Westra et al. | |
| 6,077,016 A | * | 6/2000 | Geiser et al. | 412/1 |
| 6,142,721 A | * | 11/2000 | Marsh | 412/1 |
| 6,193,458 B1 | * | 2/2001 | Marsh | 412/1 |

(Continued)

FOREIGN PATENT DOCUMENTS

| | | |
|---|---|---|
| FR | 2331852 | * 11/1975 |
| WO | WO99/38707 | * 8/1999 |
| WO | WO00/66366 | 11/2000 |

OTHER PUBLICATIONS

PCT Written Opinion in PCT/US02/36610, mailed Feb. 10, 2005.*

*Primary Examiner*—Daniel W. Howell
*Assistant Examiner*—Mark Henderson
(74) *Attorney, Agent, or Firm*—Polster, Lieder, Woodruff & Lucchesi, L.C.

(57) ABSTRACT

A perfect bound book construction is disclosed in which the book has a book block comprising a plurality of text pages, and a soft paper cover. The inner and outer faces of the cover are laminated with a plastic film so as to form a double laminated cover. The center portion of the inner lamination of the double laminated cover is conditioned or roughened, as by scarifying, so that an adhesive will adhere to the inner lamination and bind the spine of the book block to the double laminated cover. Apparatus for and a method of printing books on demand with such double laminated covers is also disclosed.

25 Claims, 26 Drawing Sheets

U.S. PATENT DOCUMENTS 6,213,703 B1 4/2001 Garrido
6,443,682 B2 * 9/2002 Marsh ..... 412/16
6,666,641 B2 * 12/2003 Weers ..... 412/4
6,773,034 B1 * 8/2004 Melcher ..... 281/38
2001/0041114 A1 * 11/2001 Melcher ..... 412/1
2002/0034428 A1 * 3/2002 Marsh ..... 412/16
2002/0061238 A1 * 5/2002 Marsh ..... 412/9
2002/0119029 A1 * 8/2002 Cobene et al. ..... 412/4

* cited by examiner

PERFECT BOUND BOOK HAVING A DOUBLE LAMINATED COVER AND METHOD OF AND APPARATUS FOR MANUFACTURING SAME

CROSS REFERENCE TO RELATED APPLICATIONS

Not Applicable.

BACKGROUND OF THE INVENTION

This invention relates to perfect bound books, and to apparatus and methods for manufacturing such books. Such perfect bound books typically comprise a book block having a plurality of paper text pages and a soft paper cover wrapped around one edge of the book block (referred to as spine). An adhesive is applied to the spine (or to a central portion of the cover) such that when the cover is wrapped around the book block the portion of the cover in engagement with the adhesive will be adhered to the spine. Of course, the adhesive also binds the edges of the text pages along the spine.

Typically, the cover of such perfect bound books is of a heavier stock than the text pages. The cover stock is also typically of a coated paper stock so as to give a better image when a color cover is printed, which is typical. In certain covers, only the outer face of the cover on which the cover graphics appears is so coated.

It has been known that if the outer face of the cover of such perfect bound books was covered or laminated with a clear plastic film, such covers were more durable and would protect the cover from water damage and hard use. However, because only the outer face of the cover was so laminated, these covers had a tendency to curl up away from the book block. It was known that if both the inner and outer faces of the cover were so laminated, such cover curling could be reduced or eliminated. However, if the inner face of the cover was so laminated, it was difficult for the adhesive to bind the cover to the spine of the book block.

In recent years, it has been advantageous to print such perfect bound books on demand. Apparatus for printing, binding and trimming such print on demand (POD) books is disclosed in my co-pending U.S. Patent Provisional Application No. 60/254,106, filed Dec. 8, 2000, and U.S. Provisional Patent Application No. 60/281,524 filed Apr. 4, 2001, now U.S. Patent Non-Provisional Application No. U.S. 2002/0064436 A1, published May 30, 2002, which is herewith incorporated by reference. As disclosed in this co-pending application, such POD books may be of different sizes and thicknesses with a limited range (e.g., any size between 5 inches×7 inches to 8½ inches×11 inches, and thicknesses from about 25 pages to 1000 or more pages). Reference may also be made to my U.S. Pat. No. 6,193,458 for apparatus and methods for binding and trimming perfect bound book. Reference may also be made to my U.S. Pat. No. 6,142,721 which discloses a system and method for perfect binding a cover to a book block in which a cold or room temperature adhesive is activated by an ultrasonic horn to bind the cover to the spine of the book block. Both of these afore-mentioned patents are herein incorporated by reference.

There has long been a need for a perfect bound book with a double laminated cover (i.e., a cover with both its inner and outer faces laminated) in which the adhesive will securely bind the inner face of the laminated cover to the spine of the book block.

SUMMARY OF THE INVENTION

Among the several objections of this invention may be noted the provision of a perfect bound book with a double laminated cover which is securely adhered by a conventional adhesive (either a hot melt or a cold adhesive) to the spine of a book block;

The provision of such a perfect bound book wherein a central portion of the inner face of the double laminated cover is conditioned to enable binding by the adhesive to the cover and to the spine of the book block;

The provision of such a perfect bound book wherein the central portion of said inner face of the double laminated cover is conditioned by scarifying (i.e., by forming a closely spaced series of punctures, slits or cuts in) the inner lamination;

The provision of such a perfect bound book wherein upon scarifying said inner face of said double laminated cover, the printing on the front face of the cover and the outer lamination are not indented or otherwise marked;

The provision of such a perfect bound book in which the central portion of said cover may be conditioned in line with the steps of laminating the cover;

The provision of a method of manufacturing a perfect bound book printed on demand having a double laminated cover;

The provision of apparatus for printing on demand a book and a cover, for double laminating the cover, and for perfect binding the book block and the double laminated cover; and The provision of such apparatus in which a cover is printed on demand, double laminated, and conditioned prior to such cover being bound to its corresponding book block.

Briefly stated, a perfect bound book of the present invention comprises a book block having a multiplicity (many) of paper pages with one edge of the book block constituting a spine. The book further comprises a paper cover having an outer face and an inner face. An outer plastic film lamination is laminated to the outer face of the cover and an inner lamination is laminated to the inner face of the cover. The inner face of the cover and of the inner lamination has a central portion. An adhesive is disposed between the spine and the central portion for binding the book block to the central portion of the inner face of the cover. The central portion of the inner face of the cover and of the inner lamination are conditioned so that the adhesive adheres to the paper cover.

The present invention also includes a method of making a perfect bound book having a book block comprising a multiplicity of paper pages, and a paper cover having an inner face and an outer face. The book block has one edge thereof referred to as a spine. This method comprises the steps of: forming the book block; laminating a suitable plastic film to the outer face of the cover so as to constitute an outer lamination; laminating a suitable plastic film to the inner face of the cover so as to constitute an inner lamination; conditioning a central portion of the cover and of the inner lamination such that the adhesive may at least in part be in direct contact the cover; applying an adhesive so as to be disposed between the spine and the central portion of the cover and of the inner lamination upon binding of the book; bringing the central portion of the cover and of the inner lamination together with the spine of the book block into binding engagement with the adhesive therebetween; and clamping the cover to the book block proximate the spine so that the adhesive adheres the cover to the spine of the book block.

Still further, the present invention includes a method of printing a book on demand and of perfect binding the book in a double laminated cover. The book has a book block comprising a plurality of paper text pages, and a paper cover having an inner face and an outer face. The book block has one edge constituting a spine. The cover has an outer lamination of plastic film applied to the outer face of the cover and an inner lamination applied to the inner face of the cover. The method comprises the steps of: printing the text pages corresponding to the book being printed on demand; stacking the printed text pages to as to form the book block; printing the cover corresponding to the book being printed on demand; laminating the outer and inner laminations to the inner and outer faces of the cover; conditioning a portion of the inner face of the laminated cover in an area to be adhered to the spine of the book block so as to permit the adhesive to be at least in part in direct adhesive contact with the paper cover through the inner lamination; applying a suitable adhesive to the spine of the book block; bringing the spine with the adhesive thereon into binding relation with conditioned cover portion so that the adhesive adheres directly to the conditioned portion of the cover; and clamping the cover to the book block proximate the spine for a time sufficient to effect binding of the book block to the cover so as to form a perfect bound book has a double laminated cover.

Still further, the present invention comprises apparatus for printing a perfect bound book on demand, the book comprising a book block has a multiplicity of paper pages, one edge of the book block constituting a spine, a soft paper cover, the cover has an outer face and an inner face, the cover has an outer lamination adhered thereto and the inner face of the cover has an inner lamination adhered thereto, the inner face of the cover has a central portion adhesively bonded to the spine, the apparatus comprises: a text printer for printing the pages comprising the book block; a cover printer for printing at least the outer face of the cover; a lamination station for laminating a plastic film to both the outer face and the inner face of the cover after the latter has been printed by the cover printer; a cover conveyor for conveying the cover to the lamination station; a carriage receiving the book block after the text pages have been printed by the text printer; the carriage transporting the book block along a work path from a receiving station in which the carriage receives the book block to an adhesive application station in which an adhesive is applied to the spine of the book block, and thence to a binding station; a laminated cover conveyor for transporting the cover from the lamination station to a cover conditioning station and thence to the binding station; the cover conditioning station conditioning a central portion of the inner face of the cover and of the inner lamination so that the adhesive will at least in part adhere directly to the paper cover through the inner lamination when the spine of the book block and the cover are brought into binding relation at the binding station; the laminated cover conveyor transporting the laminated cover to the binding stations such that the central portion of the cover is in register with the spine; and the binding station has a binding clamp engageable with the outer face of the cover proximate the spine so as to forcibly clamp the cover to the book block with the spine being substantially in register with the conditioned central portion whereby the adhesive bonds the cover to the spine.

Other objects and features will be in part apparent and in part pointed out hereinafter.

BRIEF DESCRIPTION OF THE DRAWINGS

Corresponding reference characters indicate corresponding parts throughout the various views of the drawings.

DESCRIPTION OF PREFERRED EMBODIMENTS

Figure 1:
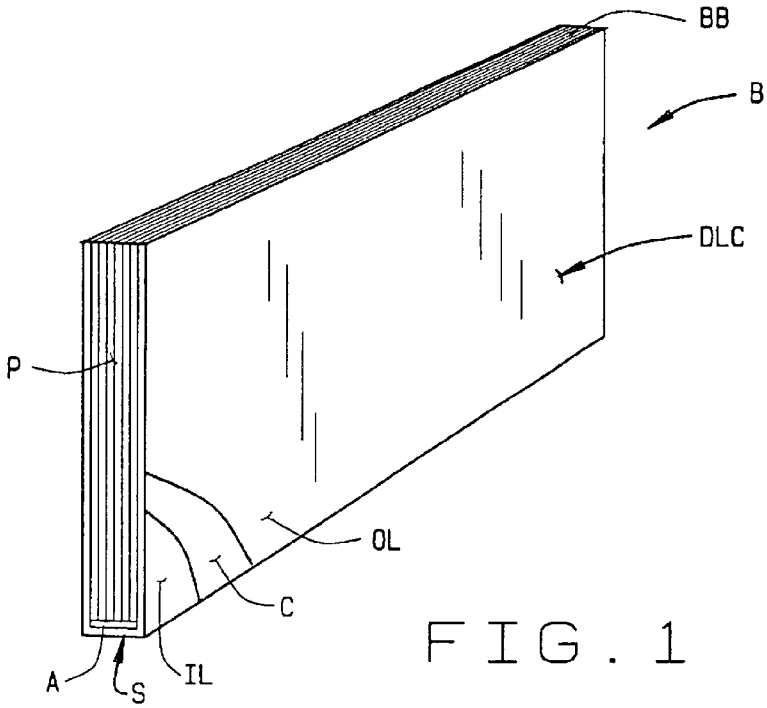
FIG. 1 is a perspective view of a perfect bound book of the present invention having a double laminated cover with portions of the cover broken away to illustrate the outer lamination, the cover, and the inner lamination.

Referring now to the drawings, a perfect bound book B of the present invention is shown in FIG. 1 to have a double laminated cover DLC. The later includes a paper cover C of suitable paper stock as is conventionally used in the manufacture of perfect bound books. For example, the cover may be of 80 pound Utopia 3 gloss cover stock. However, any cover stock as may be used in the perfect binding of trade books or the like may be used. The double laminated cover DLC further has an inner lamination IL adhered to the inner face of cover C and an outer lamination OL adhered to the outer face of cover C. The inner and outer laminations are preferably sheets or webs of clear (transparent) plastic film adhered to the inner and outer faces of the cover such that no wrinkles, bubbles or other imperfections are present in the laminations. While any number of plastic lamination films may be suitable for such laminations, one such film is a polyester film commercially available from GBC Corporation of Chicago, Ill., and is commercially identified as HiTac Aggressive co-polymer lamination film. Such lamination film is described as a polyester film having a thickness of about 1.5 mils. And a suitable co-polymer adhesive applied to one face of the film for adhering the film to the stock to be coated. Preferably, such adhesive is heat activated so as to better facilitate adhering the film to the cover stock. However, those skilled in the art will recognize that any such film as is conventionally used for laminating purposes may be used. Of course, by providing such a double laminated cover DLC on a perfect bound book B having a soft paper cover, the durability and service life of the book is greatly increased and the color printed cover better resists water and other solvents.

As shown in FIG. 1, the double laminated cover DLC is wrapped around one edge of a book block BB, this one edge being referred to as a spine S. A layer or quantity of a suitable adhesive A binds (adhesively bonds) a central portion CP of the inner face of the inner lamination IL to the spine S of the book block along the length of the spine. In general, the central portion CP of the cover is approximately equal to the thickness of the book block BB to be bound. As is well known to those skilled in the art, the adhesive A also binds the edges of the paper pages P constituting the book block BB to one another along the spine. Typically, the adhesive used to bind the cover to the book block is a hot melt adhesive that is normally recommended by its manufacturer for the perfect binding of books. One such adhesive that has worked well in conjunction with the system and method of this invention is a hot melt adhesive commercially available from Capital Adhesives of Mooresville, Ind., recommended by the manufacturer for binding books. However, any suitable hot melt or cold melt adhesive may be used in accordance with this invention. As described in my above-noted U.S. Pat. No. 6,142,721, a cold (room temperature) solid adhesive may be used in place of a hot melt adhesive when the ultrasonic apparatus, as described in this patent, is used to bind the cover to the book block. As is conventional, the other three edges or margins TM1, TM2 and TM3 of the book B may be trimmed to predetermined dimensions.

Apparatus of the present invention for the on demand printing, binding, and trimming of perfect bound books B is shown in FIGS. 14–25. Two embodiments of such apparatus are described with one embodiment indicated at 109 in FIGS. 14 and 15 and with another embodiment indicated at 199 in FIG. 22. Each of apparatus 109 and 199 include a binding and trimming apparatus 1, as described in the above mentioned U.S. Pat. No. 6,193,458, which is herein incorporated in its entirety by reference. As noted in the Brief Description of the Drawings, FIGS. 5–13 herein correspond to FIGS. 1–11 of U.S. Pat. No. 6,193,458 and the reference characters of FIGS. 5–13 correspond to the reference characters of U.S. Pat. No. 6,193,458. For a detailed description of the construction and operation of the binding and trimming apparatus 1, reference may be made particularly to Column 4, line 56—Column 20, line 39 of the noted U.S. Pat. No. 6,193,458. Further, FIGS. 14–25 herein correspond to FIGS. 13–24 of U.S. Provisional Application No. 60/281,524, filed Apr. 4, 2001, now U.S. Patent Application Publication U.S. 2002/0064436 A1, published May 30, 2004, and the reference characters of FIGS. 14–25 correspond to the reference characters of FIGS. 13–24 of said U.S. Provisional Application No. 60/281,524. As noted, these Provisional Applications and their corresponding Non-Provisional Application are herein incorporated by reference.

However, for purposes of clarity in this disclosure, certain of the more important components of the binding and trimming apparatus 1 as described in U.S. Pat. No. 6,193,458, and of the prints on demand book printing and binding apparatus, as described in said U.S. Provisional Application No. 60/281,524 as they relate to the present invention, are herein described.

Figure 14:
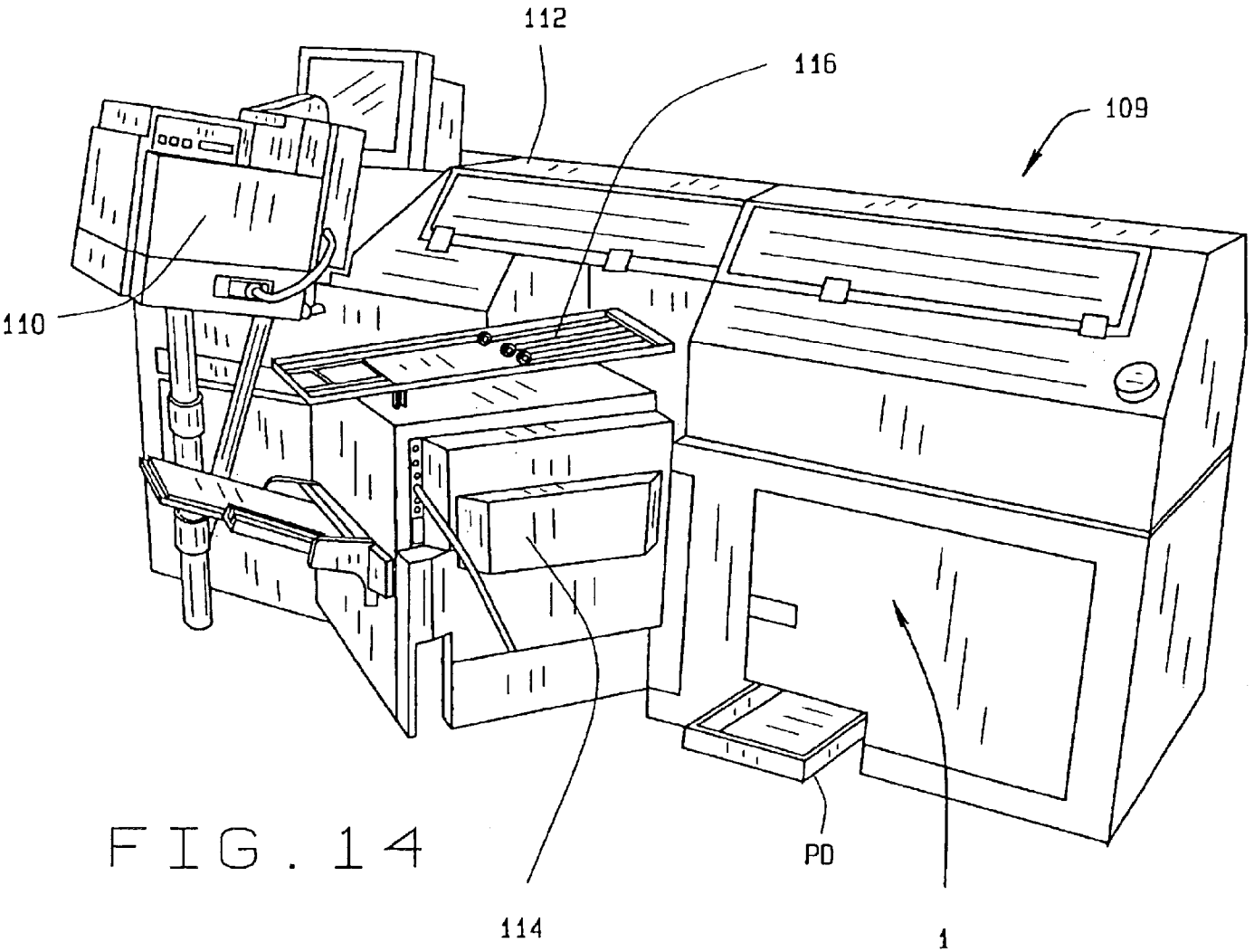
FIGS. 14–25 correspond to FIGS. 13–24 of U.S. Provisional Patent No. 60/281,524, filed Apr. 4, 2001, now U.S. Non-Provisional patent application Ser. No. U.S. 2002/0064436 A1, published May 30, 2002 and the reference characters of FIGS. 14–25 correspond to the reference characters of FIGS. 13–24 of the last-mentioned U.S. Provisional Patent Application No. 60/281,524.
Figure 22:
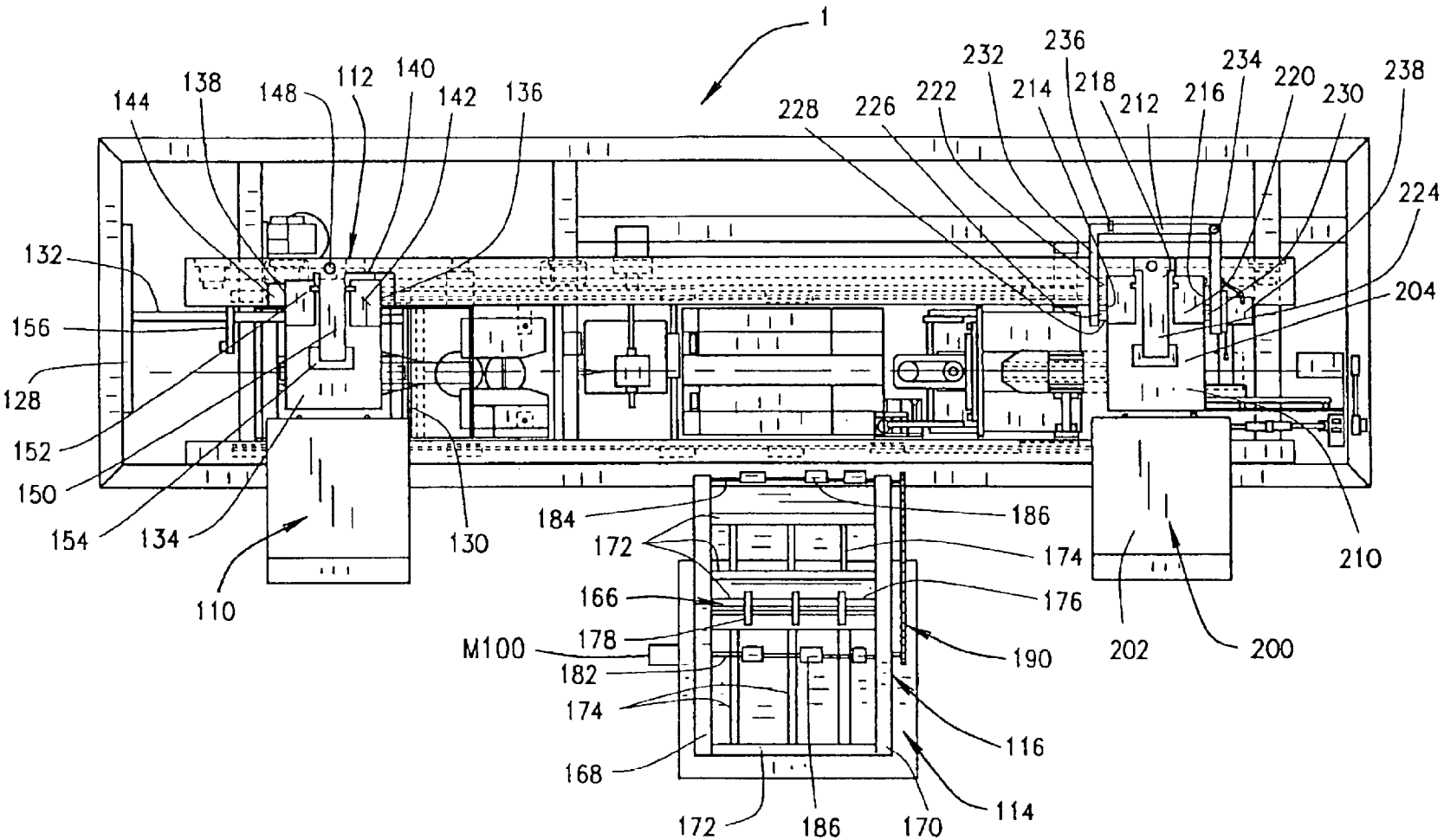

As shown in FIG. 14, the printed on demand book printing, binding and trimming apparatus 109 includes a black and white text page printer 110 and a color cover printer 114. The apparatus 199, as shown in FIG. 22, has a first black and white text page printer 110 at one end of the binding and trimming apparatus 1, a second black and white text page printer 200 at the other end of the binding and trimming apparatus, and a color cover printer 114 located between the text page printers 110 and 200.

It will be appreciated that the apparatus 109 and 200 may utilize a wide variety of black and white text page printers and color cover printers. It is desirable that the text page printers be capable of duplex printing so that both sides of sheets of paper be printed with the text. Of course, it will be recognized by those skilled in the art that both roll fed and sheet fed printers may be used. It will also be recognized that faster text page printers and faster color cover printers will result in a greater throughput for the apparatus in terms of the number of books/hour that the apparatus can print, bind and trim. One text page printer that has been successfully been used with the above apparatus is a QMS4032 and the color cover printer that has been used is a QMS330EX. These printers are commercially available from QMS of Mobile, Ala. However, it is to be emphasized that printers of any manufacturer and of any output capability can be used with the apparatus 1 in place of prints 110, 114, or 200, as shown herein. In fact, it is intended that with both such apparatus that the binder trimmer 1 is not dependent on the particular printers used because new printers of more capability at lower cost are continuously being introduced by various printer manufacturers.

Figure 5:
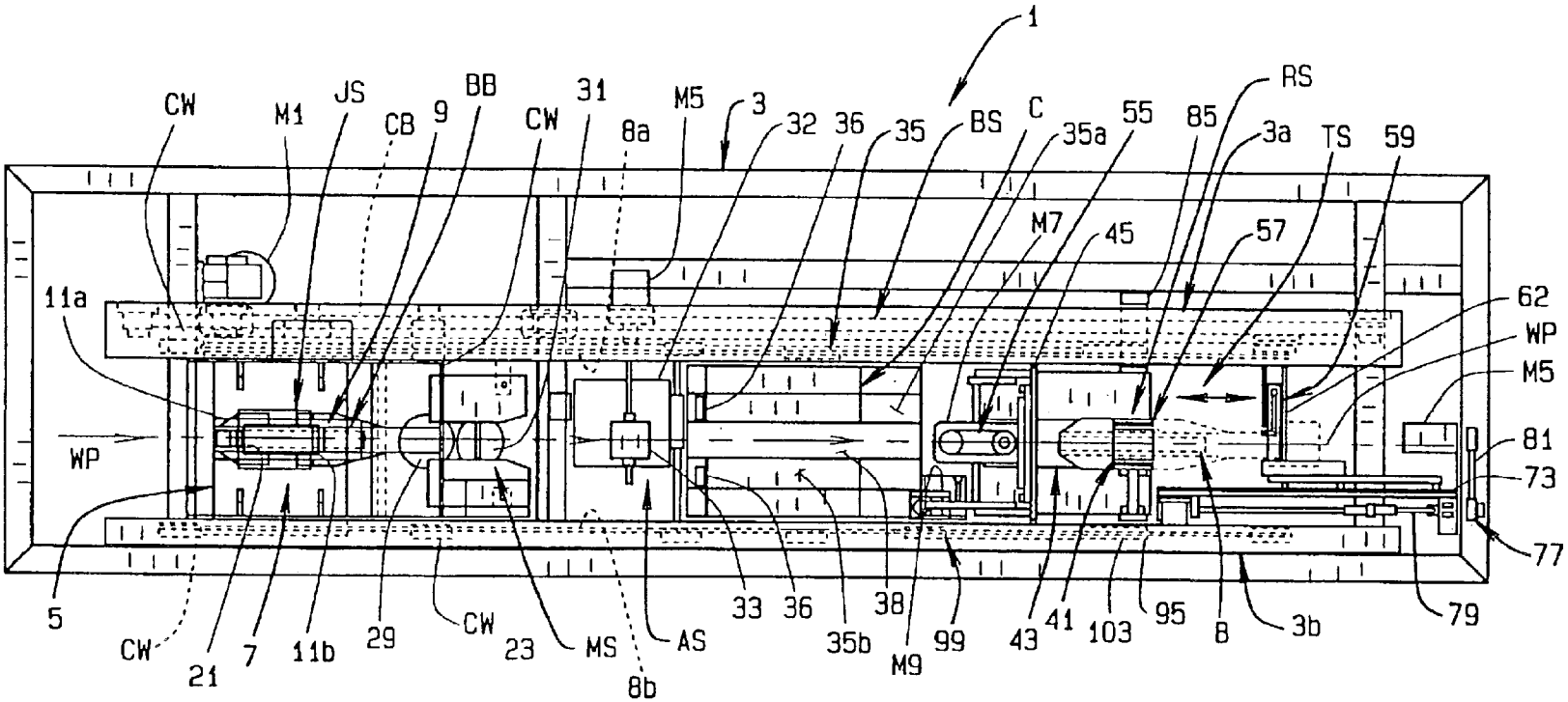
FIGS. 5–13 correspond to FIGS. 1–9 of U.S. Pat. No. 6,193,458 and the reference characters of FIGS. 5–13 correspond to FIGS. 1–9 of said U.S. Pat. No. 6,193,458.

Referring to FIG. 5, the binding and trimming apparatus 1 has a frame 3 supporting a pair of spaced horizontal frame rails 3*a*, 3*b* extending substantially the length of the frame. A conveyor 5 is provided between the frame rails for transporting the book block BB along a work path WP. The conveyor 5 includes a carriage 7 movable along the rails 3*a*, 3*b* on carriage wheels CW. The carriage is driven along the rails by means of a toothed conveyor belt CB which in turn is driven by motor M1. The carriage 7 has a clamp or holder for receiving book block BB with the spine S extending downwardly below the carriage. The carriage 7 is movable along the work path WP from a first text page receiving and jogging station JS (as shown in FIG. 5), as is shown to be at the left-hand end of the frame 3 in FIG. 5. The carriage is movable from the page receiving and jogging station JS to a milling station MS at which the spine of the book block BB held by carriage 7 is roughened or grooved by a milling head 31. The carriage 7 along with book block BB is thence movable to an adhesive application station AS which includes a heated bath 32 of hot melt adhesive A and an adhesive application roller 33. The roller 33 applies the adhesive so as to be disposed between the cover and the spine of the book block and this is typically done by roller 33 coating the spine S of the book block BB as the carriage transports the book block over the roller.

While the apparatus described herein is shown to utilize a hot melt adhesive, those skilled in the art will recognize that a cold (room temperature) adhesive could be used as well. In addition, the ultrasonic book binding apparatus and method, as described in my U.S. Pat. No. 6,142,721, issued Nov. 7, 2000 may be utilized. This last-mentioned U.S. Pat. No. 6,142,721 is herein incorporated by reference.

A binding station BS is located along the work path WP downstream from the adhesive application station AS. Binding station BS includes a pair of low profile clamping jaws 35*a*, 35*b* mounted on a bed or surface 38. A cover (i.e., either a double laminated cover DLC or a non-laminated cover C) for the book to be perfect bound is accurately located at the binding station with a center portion CP of the cover (see FIG. 3) located substantially on the centerline of the work path WP. As described herein, the cover DLC or C may be automatically located or positioned at the binding station, or, within the broader aspects of this invention, the cover may be manually positioned within the binding station BS. The carriage 7 stops at the binding station in such position as to accurately position the book block with respect to the cover DLC or C such that the book block is substantially centered heightwise on the cover and such that the spine S of the book block is substantially centered on the center portion CP of the cover. With the cover and the book block properly positioned at the binding station, the surface 38 of the clamp 35 is raised by a cylinder 37 so that the surface 38 engages the outer surface of the center portion CP of the cover and presses the cover against the spine S of the book block BB with adhesive A disposed between. The clamping jaws 35*a*, 35*b* are then operated to close on the cover proximate the spine S of the book block thereby to draw the cover around the spine and to effect adhesive bonding of the cover to the spine and to effect bonding of the pages P in the book block to one another along the spine S. The clamping jaws or members are maintained in such clamping engagement with the cover and with the book block for a time sufficient for the hot melt adhesive to at least partially cool and to set up. Typically this takes a few seconds (e.g., 3–10 seconds), depending on the properties of adhesive A, the temperature of the adhesive, and the size and thickness of the book.

Figure 9:
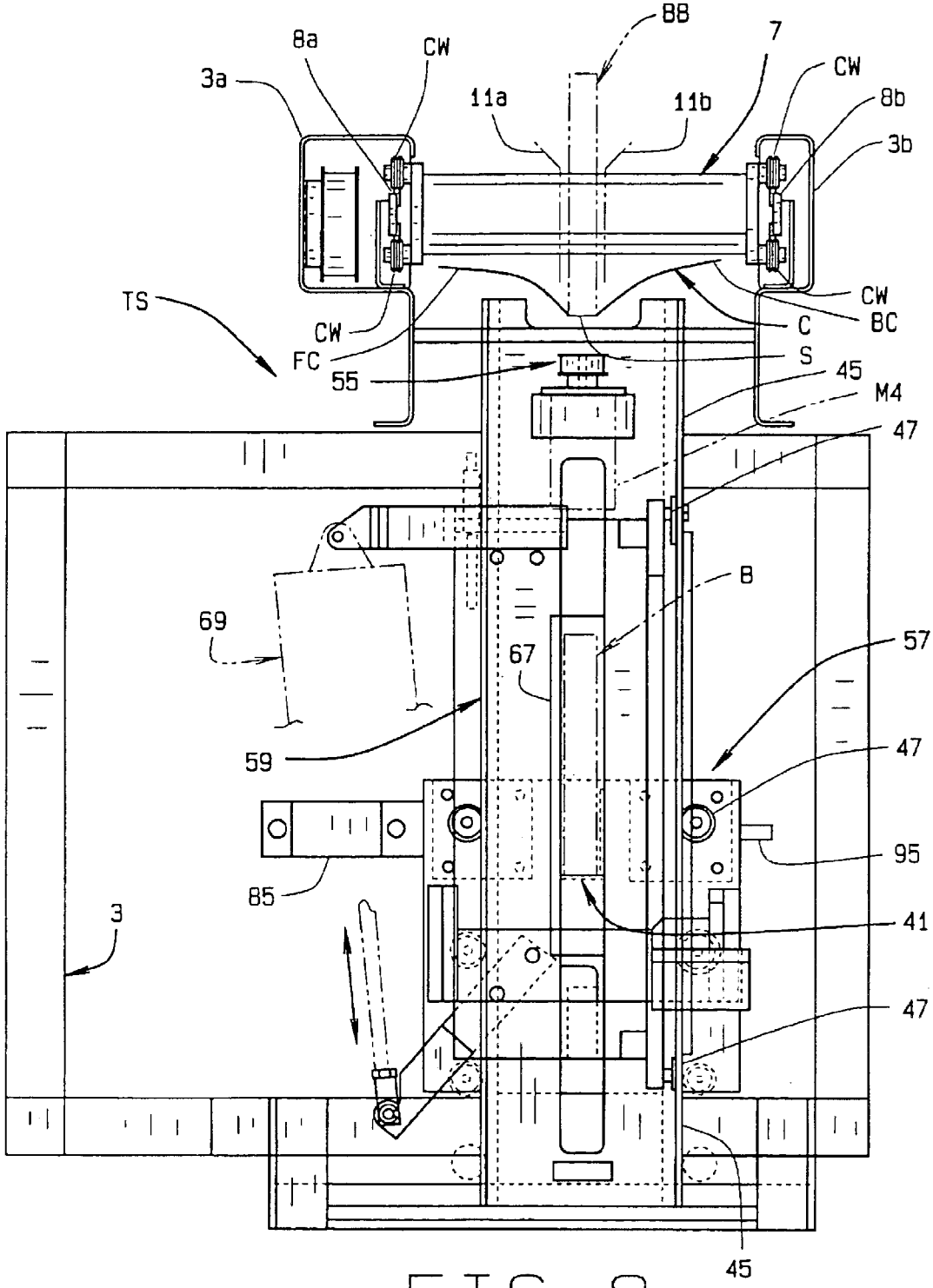
Figure 10:
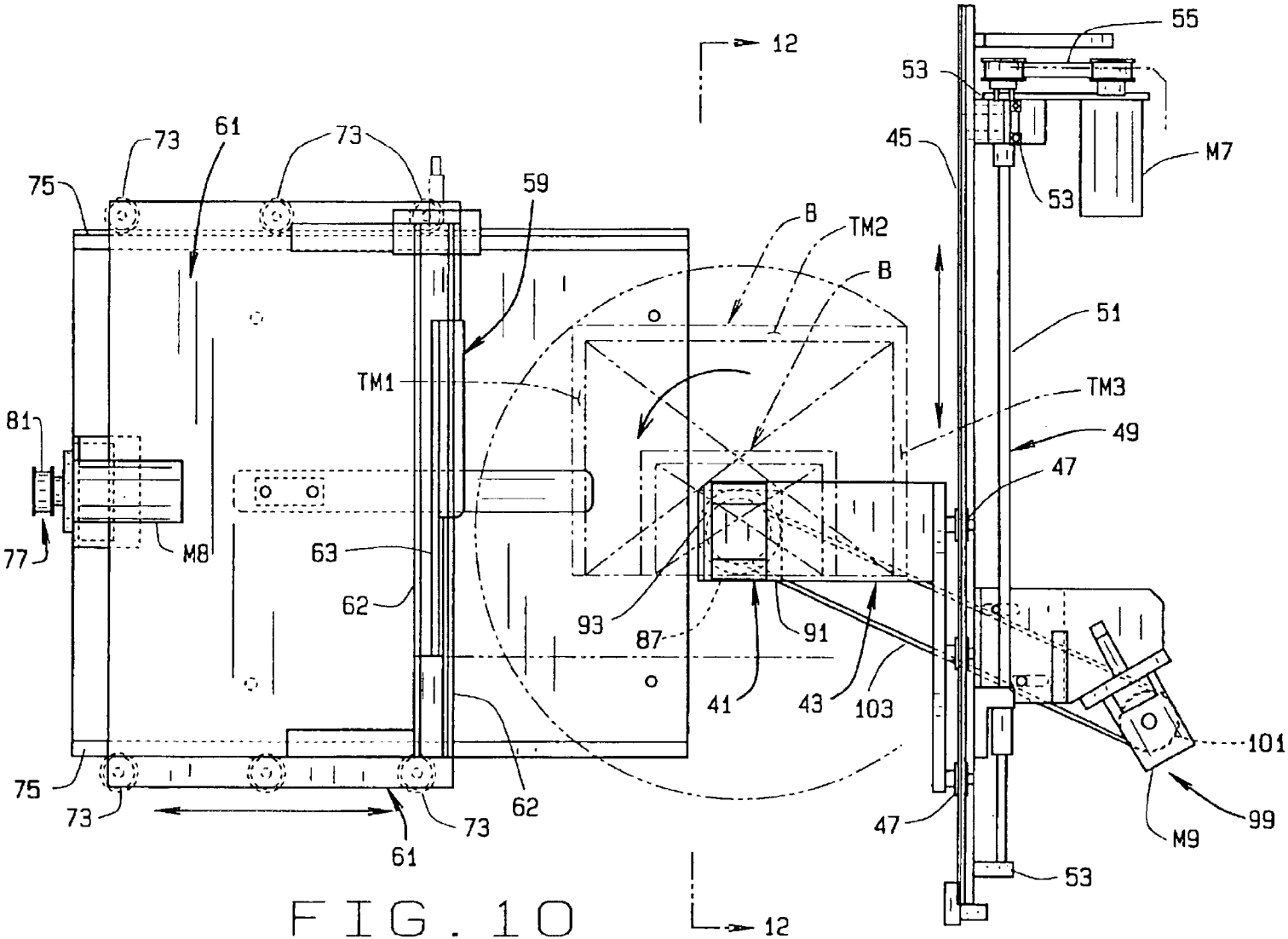
Figure 11:
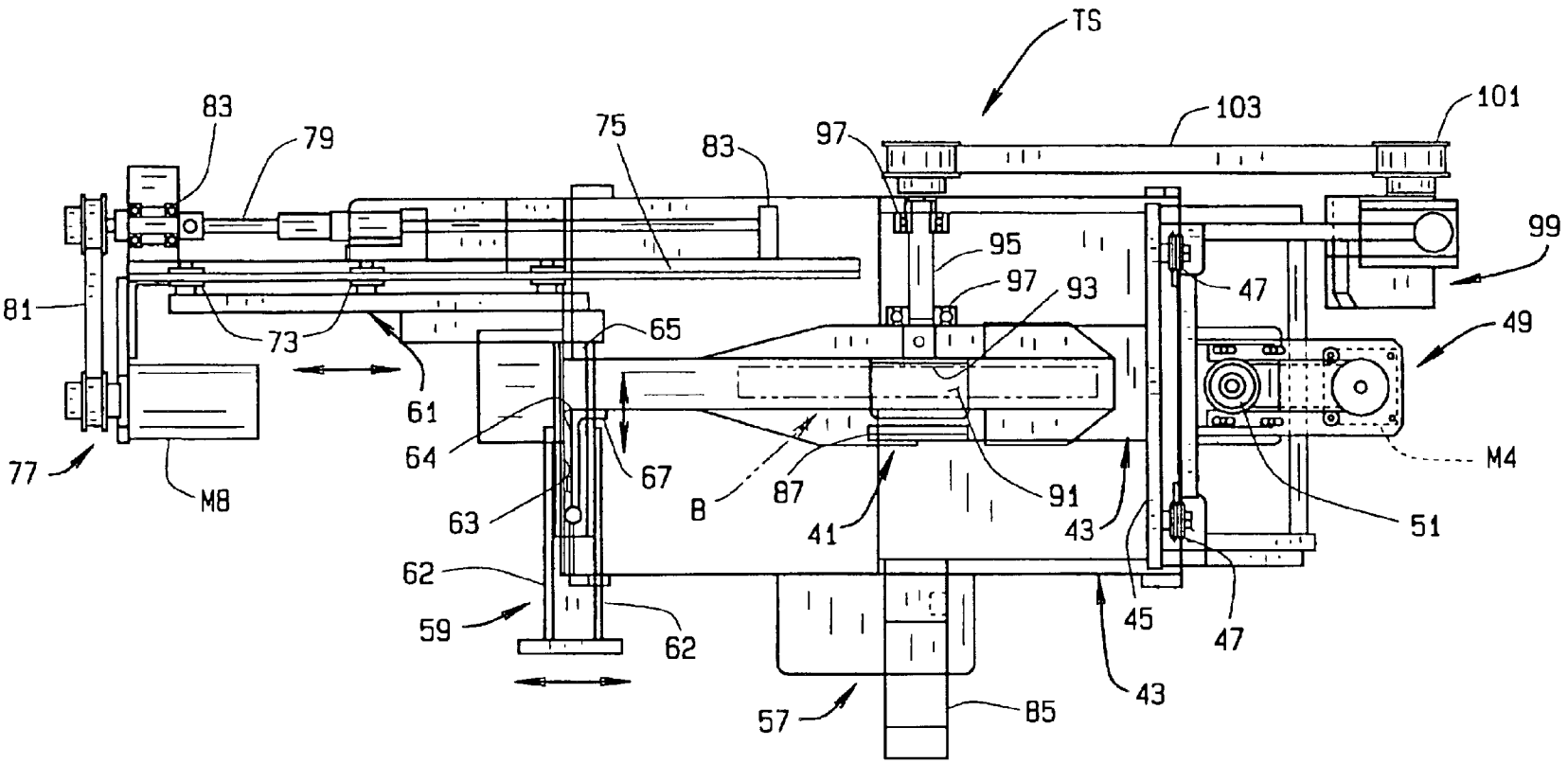

As shown in FIG. 9, after the cover DLC or C has been adhesively bonded to the spine S of the book block BB, the front and back covers FC and BC of the cover are splayed out below carriage 7. The carriage then transports the bound book B from binding station BS to a release station RS (see FIGS. 5 and 6) at which point carriage 7 releases the book block BB from its grip and the bound book B is then deposited in a nest 41. Once the bound book is transferred to nest 41, the margins TM1–TM3 of book B will be trimmed to correspond to predetermined finished dimensions for the finished book in the manner described in U.S. Pat. No. 6,193,458. Of course, after trimming of the book, the finished book is delivered to a product deliver chute PD, as shown in FIG. 14. Again, reference may be made to U.S. Pat. No. 6,193,458 for a more complete description of the construction and operation of the binding and trimming apparatus 1.

As described by my co-pending U.S. Provisional Patent Application Nos. 60/254,106, filed Dec. 8, 2000 and 60/281,524, filed Apr. 8, 2001 now U.S. Non-Patent Application Publication U.S. 2002/0064436 A1, published May 30, 2004, all of which are herein incorporated by reference, binding and trimming apparatus 1 has been modified to be a print on demand book printing, perfect binding and book trimming apparatus, as generally indicated at 109 in FIG. 14 and as generally indicated at 199 in FIG. 22. Apparatus 109 includes a text page printer, as indicated at 110 in FIG. 14. Apparatus 199 includes two text page printers, as indicated at 110 and 200 in FIG. 22. Both of these print on demand book machines includes a color cover printer 114. While the text page printers 110 and 200 are shown to be sheet fed printers, those skilled in the art will recognize that web fed page printers may be used in their place.

Typically, the pages P of the book block BB are duplex printed on both their front and back faces. The pages P are rectangular in shape and a widthwise (minor) dimension and a lengthwise (major) dimension. The pages may, for example, range between a 5×7 inch rectangular format and a 8½×11 inch rectangular format, or any number of rectangular formats within the above range. Of course, it should be understood that other formats may be accommodated by adjusting the size of the printing and binding apparatus. The printing and binding apparatus 1 of the first embodiment of the present invention automatically accommodates any book size within the range of sizes. As noted, one edge of the book block BB is referred to as the spine S of the book block. As contemplated, the spine of the book block corresponds to the lowermost horizontal edge of the book block (which is a lengthwise or major rectangular dimension of the pages of the book block) when the book block BB is placed in the carriage of the printing and binding apparatus 1, as shown in FIG. 5. The pages of the book may be printed on both sides by a suitable duplex laser printer or they may be printed by any conventional printing process (e.g., offset printed or the like).

Figure 15:
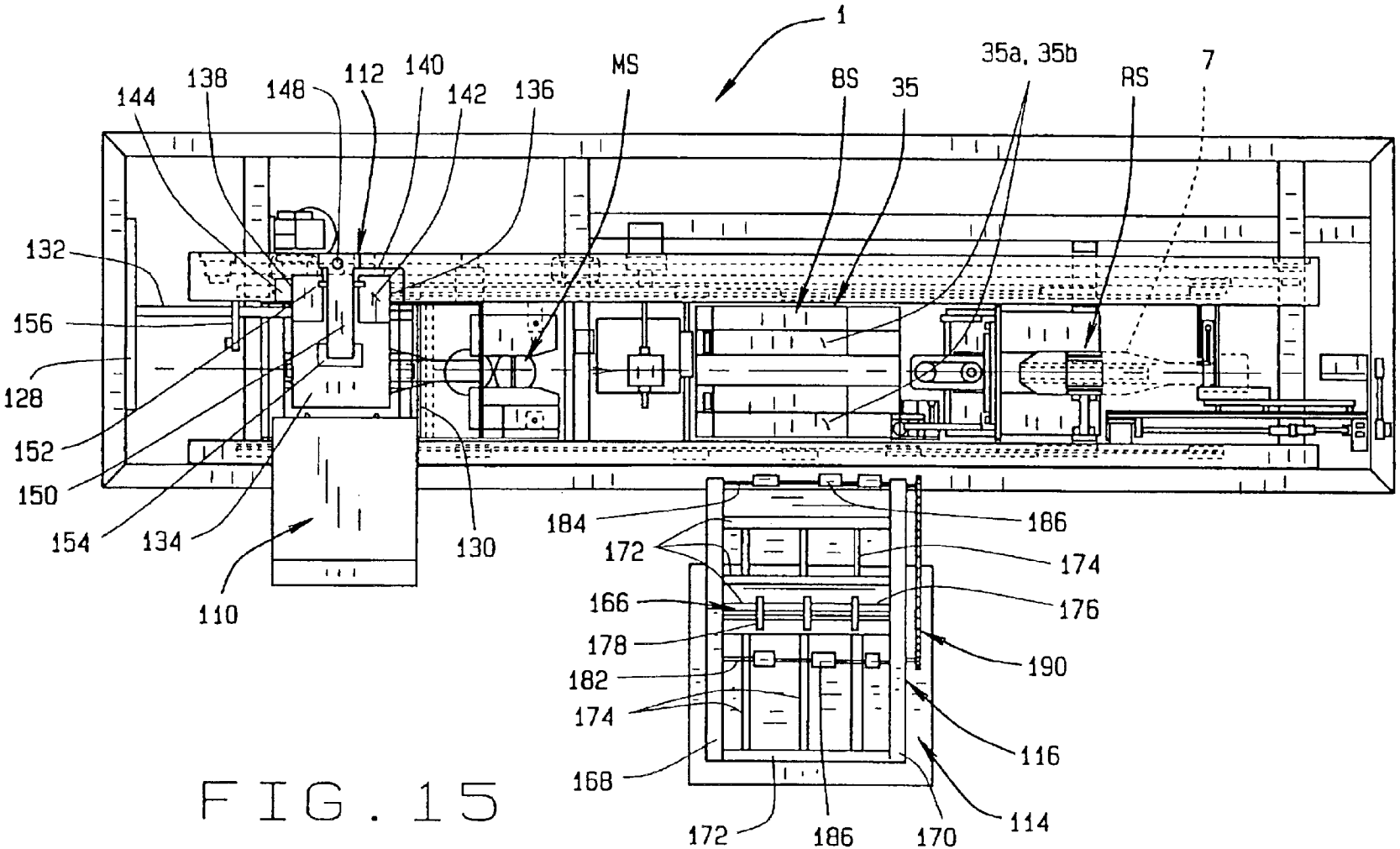
Figure 16:
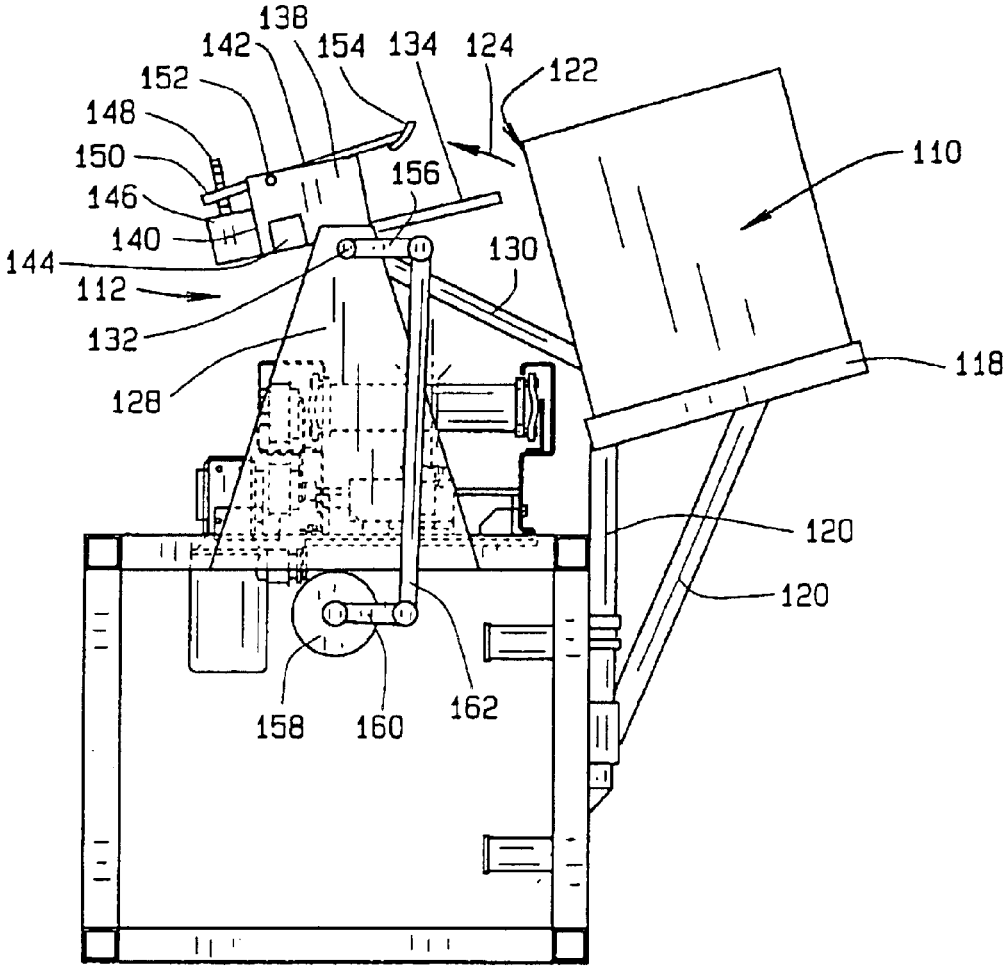
Figure 17:
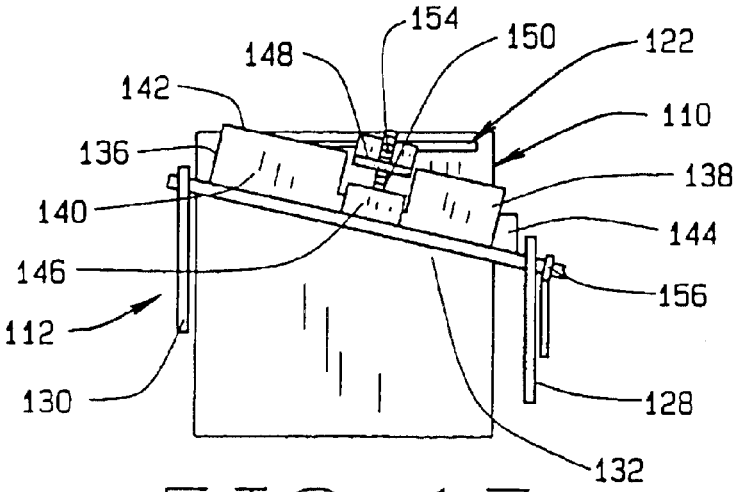
Figure 18:
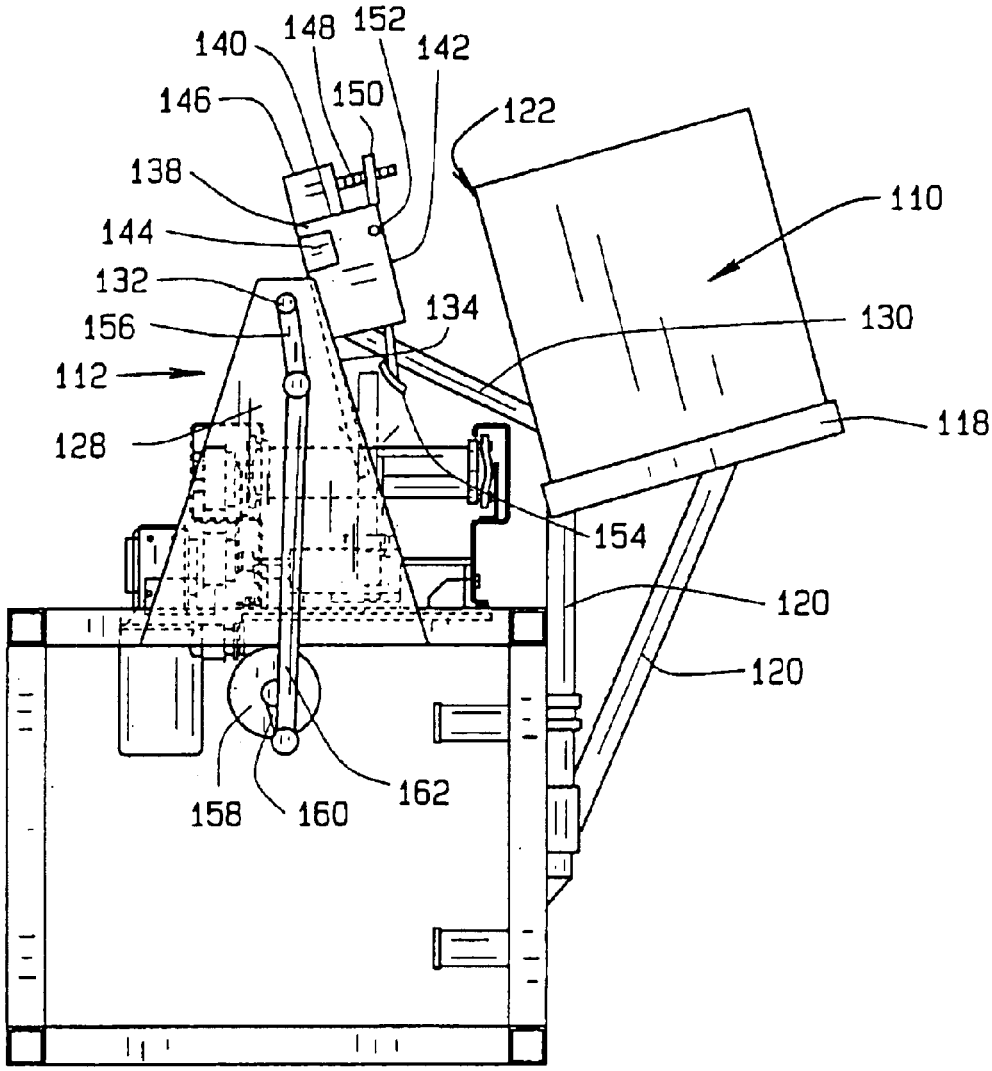

As seen in FIGS. 14–21, the book page printer 110 is integrated into the book printing and binding apparatus 1 adjacent the jogging station JS. The book page printer 110 is supported adjacent the apparatus by a support platform 118 that is attached to the tubular frame of the apparatus by a vertically hinged support 120. The support is hinged such that the printer can be swung away from its operating position when the printing and binding apparatus requires maintenance. As best seen in FIGS. 16–18, the printer platform 118 supports the book page printer 110 at an angled orientation relative to the apparatus. The page ejection slot 122 of the printer is positioned adjacent the apparatus 1 where a printed page of a book being printed by the book page printer 110 will be ejected from the printer slot 122 over the apparatus page receiving and jogging station JS. The arrow 124 indicates the direction in which printed pages are ejected from the book page printer slot 122. The operation of the book page printer 110, including the pages of the book to be printed, is controlled by the apparatus computer control system CONT 1 with which the book page printer 110 communicates.

Positioned adjacent the book page printer 110 and over the page receiving and jogging station JS of the apparatus 1 is the book page printer transfer mechanism 112. The page transfer mechanism 112 is supported over the jogging station JS by a support panel 128 that projects upwardly from the frame 3 of the apparatus 1 at the left hand end of the apparatus as viewed in FIG. 15 and by a support rod 130 that projects outwardly over the jogging station JS from the printer hinge support 120. A shaft 132 is mounted for rotation to the support panel 128 and to the support rod 130 and projects over the jogging station JS. As best seen in FIG. 17, the shaft 132 is angled slightly such that the end of the shaft closest to the left hand end of the apparatus 1, as viewed in FIG. 15, will be slightly lower than the opposite end of the shaft. Mounted on the shaft 132 for rotation therewith is a rectangular tray 134. The tray 134 projects out to a position adjacent the page ejection slot 122 of the book page printer 110 where it will receive printed pages ejected from the printer. As best seen in FIG. 16, the tray 134 on the shaft 132 angles downwardly away from the book page printer 110 and is also angled downwardly toward the left hand end of the apparatus as shown in FIG. 15. Mounted at the back of the tray 134 is a box shaped bin having first 136 and second 138 side walls, a rear wall 140, and a top wall 142. The bin receives pages ejected from the page printer 110 and holds the pages on the tray 134 in the initial formation of the book block. A vibrating mechanism 144 is mounted on the second side wall 138 of the bin. Operation of the vibrating mechanism 144, which is controlled by the control system CONT 1, provides an initial jogging and collating of the printed pages of the book block on the tray 134 toward the back wall 140 and the second side wall 138 of the transfer mechanism 112 due to the angled orientation of the shaft 132 and the tray 134 on the shaft.

Mounted on the back wall 140 of the tray 134 is a small reversible, direct current clamping mechanism motor 146. The clamping mechanism motor 146 is selectively controlled by the control system CONT 1 to rotate a screw shaft 148 of the motor in opposite directions. The screw shaft 148 is threaded into a clamping arm 150 at one end of the arm. The arm 150 is mounted by a pivot pin 152 connection to the top wall 142 of the tray bin. The arm has a clamping pad 154 at an opposite end of the arm from the screw shaft 148. Rotation of the screwshaft 148 by the clamping mechanism motor 146 in one direction will cause the arm to pivot about its pivot pin 152, thereby allowing the clamping pad 154 to clamp down on the book block that has been initially collated in the bin of the transfer mechanism 112. Rotation of the screwshaft 148 in the opposite direction will cause the clamping pad 154 to pivot away from the book block, thereby releasing the book block. Contact switches (not shown) are mounted on the clamping arm to produce signals that indicate when a book block is clamped securely by the arm and when the arm is moved to a position to release a book block.

A shaft arm 156 is secured to the transfer tray shaft 132 and projects outwardly a short distance from the shaft. An alternating current transfer mechanism motor 158 is mounted to the frame 3 of the apparatus 1 as shown in FIGS. 16–18 and has a motor arm 160 that is secured to the motor shaft and that projects outwardly from the motor shaft. The shaft arm 156 and the motor arm 160 are interconnected by a connecting rod 162 that is mounted to the two arms at its opposite ends by pivot connections. Selective operation of the transfer mechanism motor 158 will cause its shaft, the motor arm 160, and consequently the shaft arm 156 to move through an arc segment which causes the tray 134 to pivot between a printed page receiving position shown in FIG. 15 and a book block depositing position shown in FIG. 17. The motor arm 160 is preferably shorter than the shaft arm 156 such that the tray 134 will move from the page receiving position, to the book block depositing position, and back to the page receiving position simply by rotating the motor arm 160 through a 360° rotation. This allows the transfer mechanism motor 158 to be a simple, non-reversible motor. Those skilled in the art will recognize that the above described non-reversible motor could be replaced by a pivoting air cylinder and, in fact, the use of such an air cylinder may be preferred.

In operation, the tray 134 of the book page printer transfer mechanism 112 is first positioned in its page receiving position shown in FIG. 15 by operation of the transfer mechanism motor 160 that is controlled by the control system CONT 1. Pages printed by the book page printer 110 are ejected from the printer slot 122 and are collected on the tray 134. Operation of the bin vibrating mechanism 144 causes the printed pages to be initially jogged and collated as they are collected into the corner of the tray defined by the back wall 140 and the second side wall 138 of the bin. When the entire book block has been printed and initially collated on the tray 134, the clamping mechanism motor 146 is operated causing the clamping arm 150 to close down on the book block with the clamping pad 154 of the arm securely holding the printed book block on the tray. The transfer mechanism motor 160 is then operated causing the tray to move to its book block depositing position shown in FIG. 18. In this position, the clamping mechanism motor 146 is operated causing the clamping arm 150 to open and release the book block from the tray 134 such that the book block will fall into the carriage 7 that holds the book block during further steps in the printing and binding process of the book.

Figure 2:
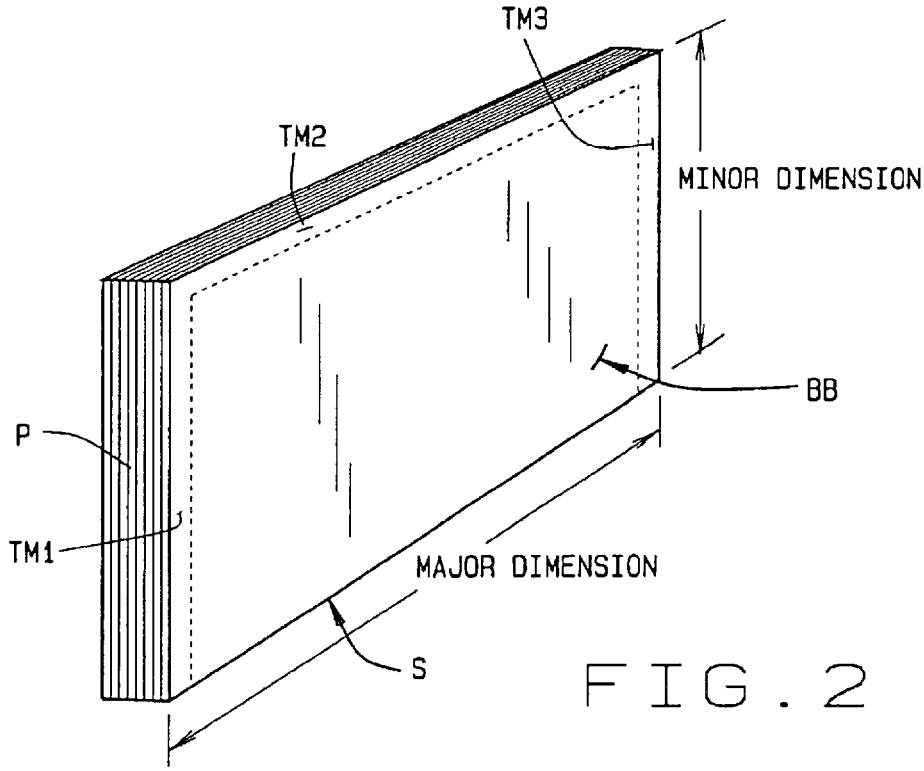
FIG. 2 is a perspective view of a book block for the perfect bound book shown in FIG. 1.
Figure 3:
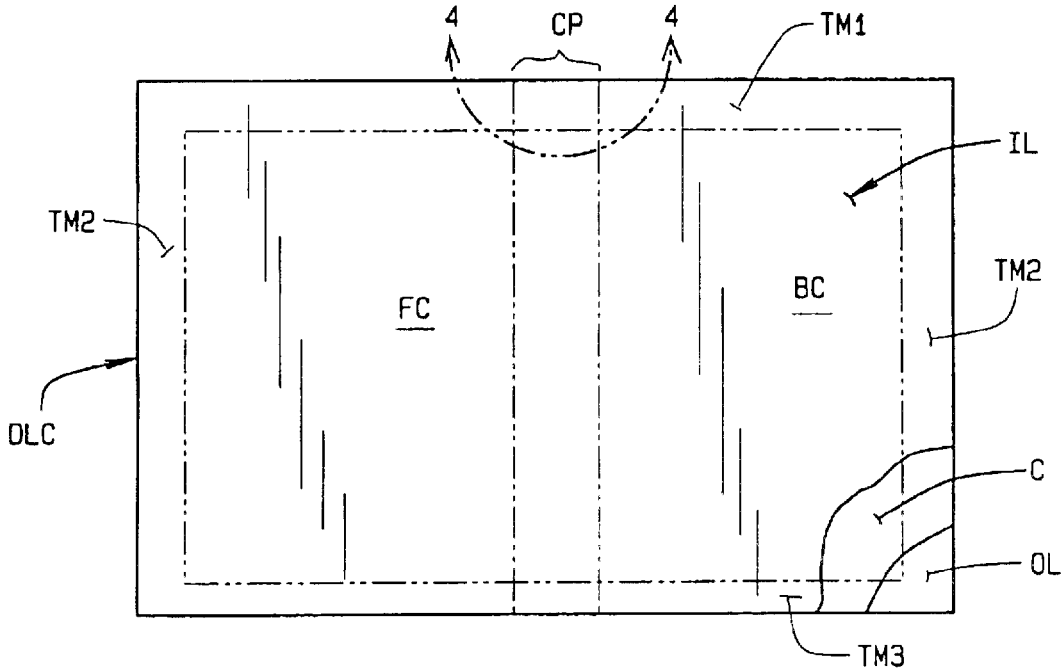
FIG. 3 is a flat pattern lay out of a double laminated cover for the book of the present invention with the inner lamination facing upwardly.

As shown in FIGS. 1 and 2, each book block BB is adapted to be bound in a suitable book cover DLC or C by a binding technique or method referred to as perfect binding. Typically, books bound by the perfect binding method are soft cover books. The book cover C is typically formed of a suitable stock of heavier weight than the pages of the book block BB and may be coated so as to have a superior finish and may be color printed. The cover has a front face FC, a back face BC, and a center portion CP therebetween. The width of the center portion CP of the cover C generally corresponds to the thickness of the book block to which it is ultimately attached. Typically, the pages P of the book block and the cover C are somewhat oversize relative to the desired size of the finished, bound book such that the margins of the bound book can be trimmed to a predetermined size after the book block has been bound to the cover to result in a perfect bound book having the desired size with even edges along the sides or margins (preferably along three sides) of the book. The oversize margins of the book block BB and of the cover C are shown as trim margins, TM1–TM3.

As noted, the book block BB and cover C may be 10 printed by any method. However, because the printing and binding apparatus 1 of the present invention is capable of instant setup for any size or format of book to be bound (i.e., the size of the pages and the thickness of the book) within a predetermined range of book sizes (e.g., from 6×9 inches to about 8½×11 inches, and any combination of rectangular sizes within such range, and in thickness ranging from about 25 pages to about 1000 pages), the printing and binding apparatus of the present invention is particularly well-suited to print, bind, and trim a single copy (or a small run quantity) of perfect bound book(s) printed on-demand as described in U.S. Pat. No. 5,465,213, the disclosure of said patent being herein incorporated by reference. In this manner, the on-demand printing apparatus of the present invention can automatically, from the data relating to the size and thickness of the book to be bound, determine (calculate) the width of the center portion CP of the cover C and the width of the trim margins TM1–TM3 so as to bind any size book within the range of book sizes that can be accommodated by the printing and binding apparatus 1 of this invention. The second book may be of an entirely different size and thickness than the first book and the printing and binding apparatus 1 will automatically accommodate this second book so long as the second book is also within the range of book sizes that can be accommodated by the printing and binding apparatus. The binding process of the printing and binding apparatus has a sufficiently fast operational cycle such that it will finish binding and trimming one book while a second book is being on-demand printed.

As shown in FIGS. 14 and 15, the book cover printer 114 is positioned adjacent the binding station BS of the printing and binding apparatus 1. The book cover printer 114 is shown pulled slightly away from the apparatus in FIG. 14 to illustrate how it can be easily separated from the apparatus for servicing. The cover printer 114 is shown in its operative position relative to the apparatus in FIG. 14. The cover printer 114 has a slot 166 on the top of the printer where color printed book covers are ejected from the printer. Mounted on the top of the cover printer is the cover printer transfer mechanism 116 that projects outwardly from the printer to a position adjacent the binding station BS of the printing and binding apparatus 1.

The cover transfer mechanism 116 is comprised of a pair of C-shaped channels 168, 170 having openings that mutually oppose each other and extend along the length of the apparatus from positions over the printer 114 to positions adjacent the binding station BS of the apparatus. A plurality of cross bars 172 extend between the two channels 168, 170 forming the frame of the cover transfer mechanism 116. An additional plurality of bars 174 extend between pairs of the cross bars 172 rigidifying the frame and providing a sliding surface for the cover to be printed by the cover printer 114. A pivot rod 176 extends across an intermediate portion of the frame and has a plurality of pawls 178 secured to the rod. The pivot rod 176 is connected to a switch 180 that controls the operation of the cover transfer mechanism 116 as will be explained.

Figure 20:
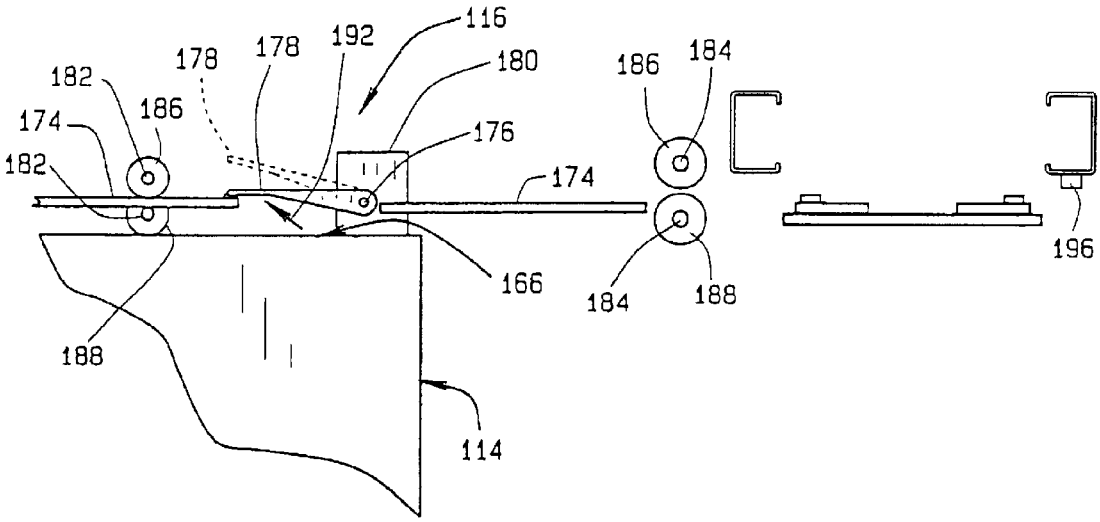
Figure 21:
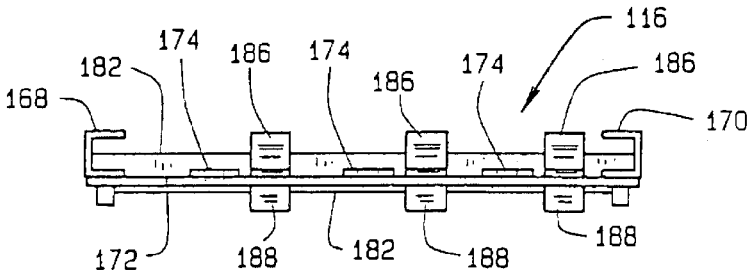

As shown in FIGS. 15, 20, and 21, two pairs of roller shafts 182, 184 are mounted for rotation to the channels 168, 170 of the frame on opposite sides of the pivot rod 176. Each of the shafts of the pairs are positioned above and below each other. Each of the pairs of shafts 182, 184 has three pairs of mutually contacting rollers 186, 188 mounted to the shafts for rotation with the shafts. The upper shafts of each pair are operatively connected together by a chain and sprocket connection 190 shown in FIG. 14. The chain and sprocket connection 190 and the mutual engagement between the roller pairs 186, 188 provide a driving arrangement between the rollers where, when the rollers on the upper shafts rotate in a clockwise direction, the rollers on the lower shafts rotate in a counter clockwise direction and vice versa. A reversible motor (not shown) is controlled by the control system CONT 1 and is operatively connected to the chain and sprocket connection 190 to drive the rotation of the upper and lower rollers in opposite directions of rotation. The motor (not shown) is also operatively connected with the pivot rod switch 180 to control the motor's direction of rotation, and thus the direction of rotation of the rollers 186, 188.

When the book cover printer 114 and its transfer mechanism 116 are operated, as each book cover is printed by the printer, the book cover is ejected from the top of the printer in the direction indicated by the arrow 192 shown in FIG. 20. The cover being ejected from the printer contacts the plurality of pawls 178 and causes the pawls to move from their first position shown in solid lines in FIG. 20 to their second position shown in dashed lines in FIG. 20. The movement of the pawls to their second position activates the pivot rod switch 180, which in turn, controls the motor of the cover transfer mechanism 116 to rotate the upper rollers 186 of each pair of rollers to rotate in the clockwise direction and the lower rollers 188 of each pair of rollers to rotate in the counter clockwise direction as viewed in FIG. 20. The cover being ejected from the cover printer 114 is received between the pairs of rollers shown to the left in FIG. 20 and the rotation of the rollers transports the cover to the left as viewed in FIG. 20 between the opposed pair of channels 168, 170 and over the sliding bars 174 of the transfer mechanism frame. This movement of the cover continues until it is completely ejected from the cover printer 114 and moves past the plurality of paws 178, causing the pawls 178 to move from their second position back to their first position shown in solid lines in FIG. 20. This movement of the pawls causes the pivot rod switch 180 to control the transfer mechanism motor (not shown) to reverse its rotation. The reverse rotation of the motor causes the upper rollers 186 of the pairs of rollers to now rotate in the counter clockwise direction and their mating lower rollers 188 to rotate in the clockwise direction. This, in turn, causes the pairs of rollers 186, 188 to transfer the cover to the right as viewed in FIG. 20 between the pairs of rollers and over the pawls 178 to the binding station BS of the apparatus. The rollers 186, 188 of the transfer mechanism 116 transfer the cover over the clamp members 35*a*, 35*b* with an edge of the cover sliding along the positioning pins 36 until the leading edge of the cover comes in contact with the stop switch 196 indicating the proper position of the cover over the center of the binding clamp 38. Alternatively, when only one size of cover stock is used to print the covers of all sizes of books, the positioning pins and the stop switch can be eliminated and replaced by a simple bin that is centrally positioned with respect to the binding clamps. In either manner, the cover printer 114 and its associated transfer mechanism 116 automatically operate to provide a color printed cover to the printing and binding apparatus 1 where it is ready to be secured to the book block by the apparatus.

Regardless of how the book block BB and cover C are printed, the book block BB is loaded in the carriage 7 which is movable along the conveyor 5 in a horizontal direction along the work path WP. As will be described in detail hereinafter, the carriage 7 is substantially centered on the work path WP and has a carriage clamping mechanism 9, which is selectively actuated to firmly hold the pages P of the book block relative to one another. This clamping mechanism 9 comprises vertical clamping members 11*a*, 11*b* which, upon actuation of the clamping mechanism, are preferably self-centering such that the book block BB, regardless of its thickness, is centered with respect to the work path WP as it is held within the carriage 7. The self-centering drive of the clamping members 11*a*, 11*b* is driven by an electric motor M2. The motor M2 drives the clamping members toward each other via a suitable self-centering gear drive (not shown) such that they firmly grip the book block BB and such that when the motor M2 stalls or stops, the clamping members exert a sufficient gripping force on the book block so as to firmly hold the pages relative to one another as the book block is transported to the various stations along the work path WP during the various operations that are preformed on the book block, as will be hereinafter described. When the book block is clamped, the clamping members 11*a*, 11*b* grip the front and back faces of the book block BB in a manner such that the lower margin adjacent the spine of the book block extends below the clamping members. The spine of the book block preferably extends approximately 2.0 cm. below the clamping members when clamped.

Figure 6:
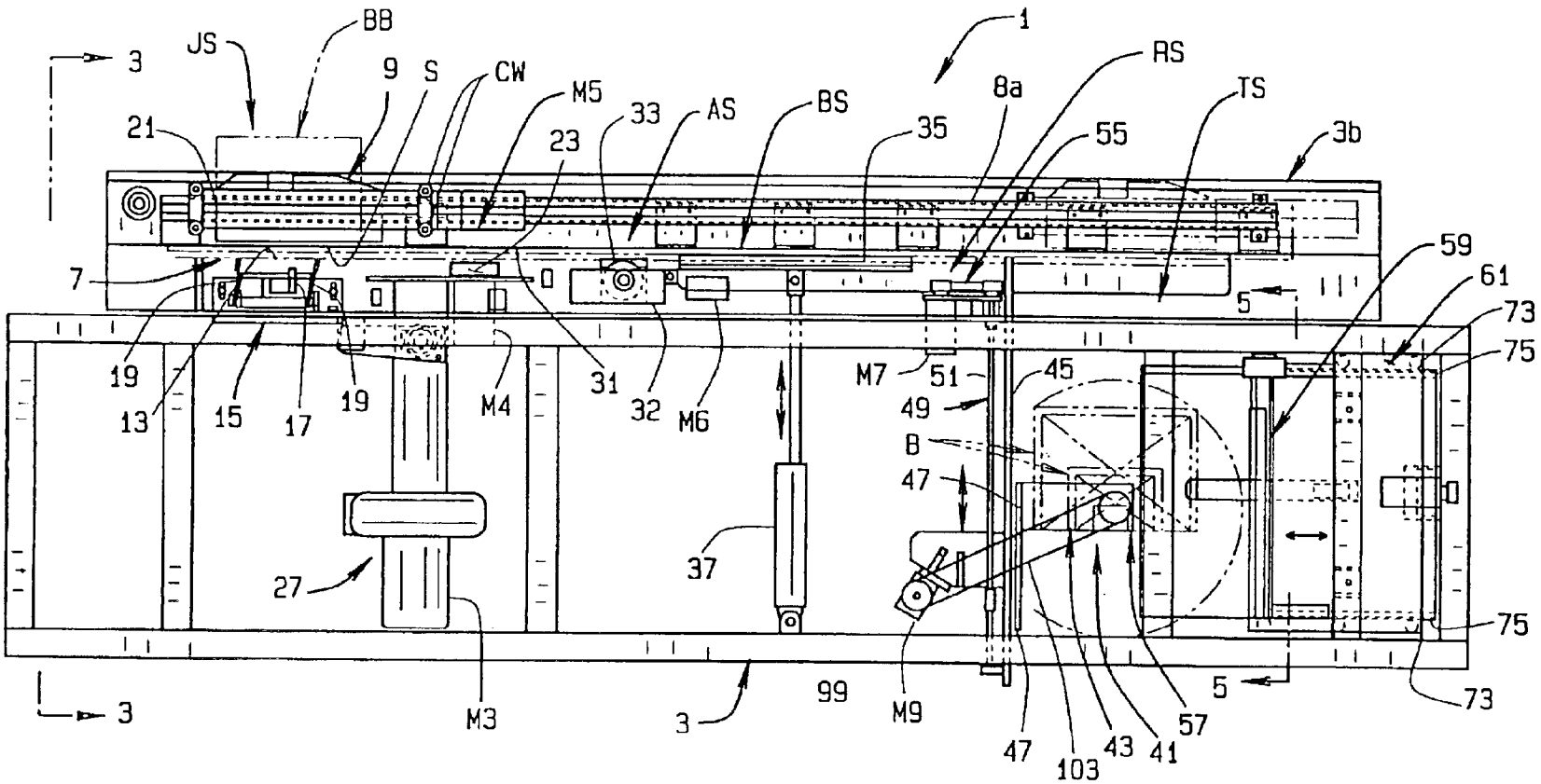
Figure 7:
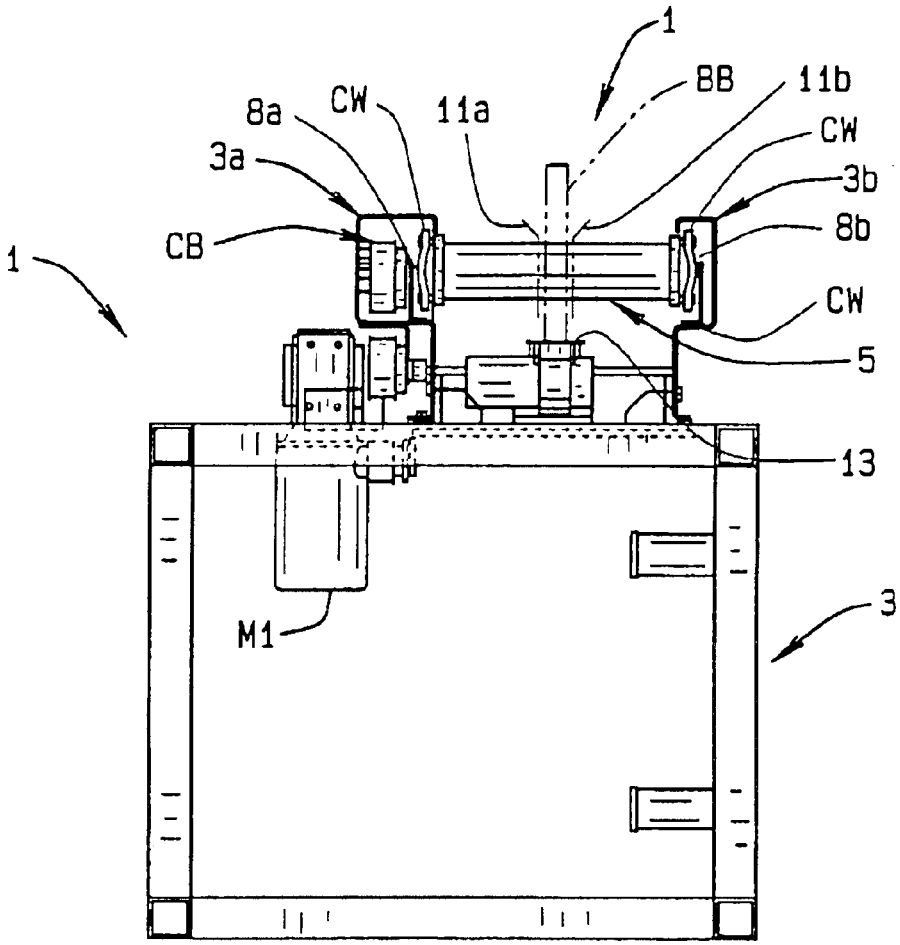
Figure 8:
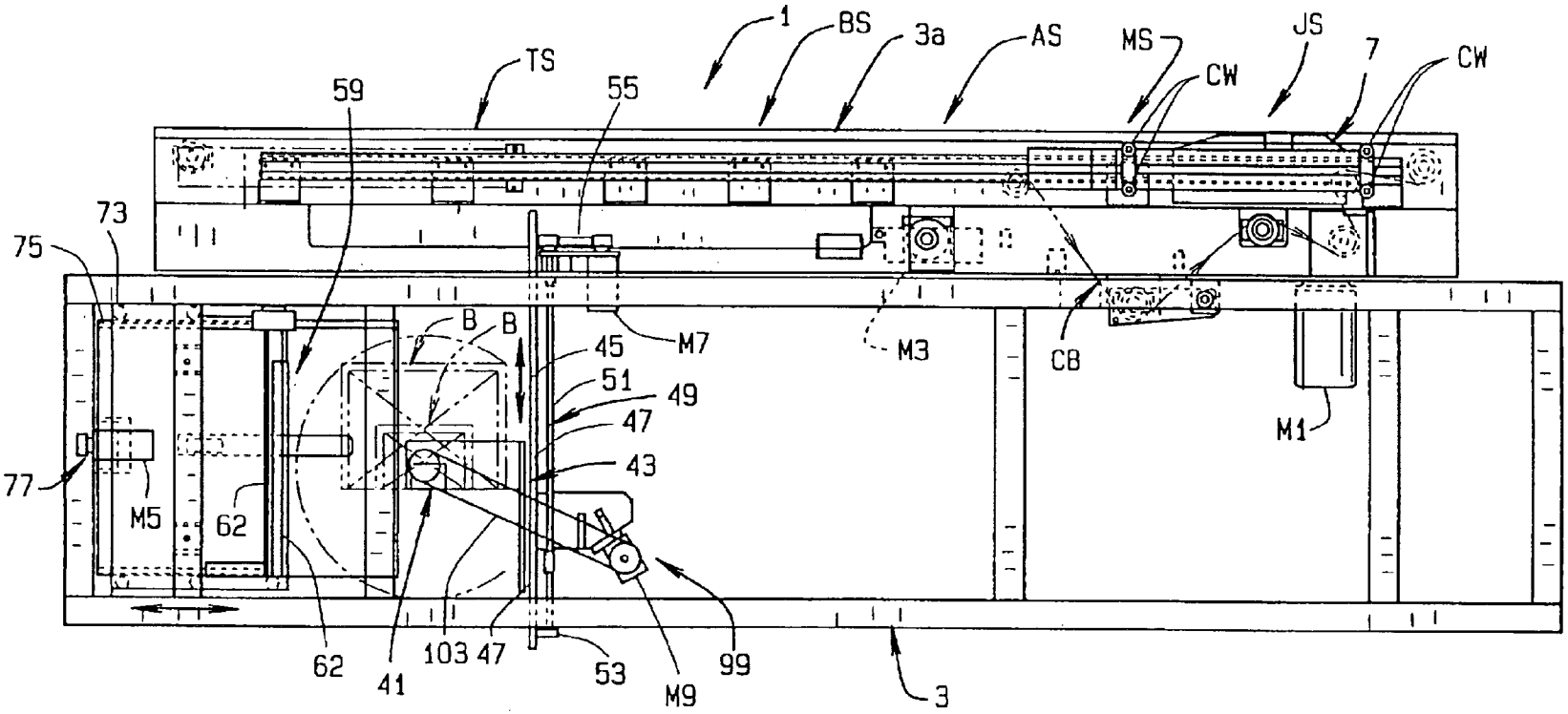
Figure 19:
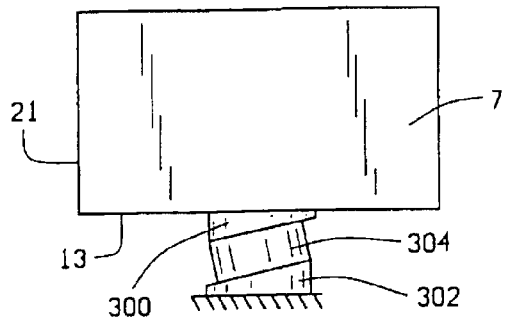

As shown in FIGS. 5, 6, and 8, the carriage 7 and the book block BB carried thereby are shown in a first station, referred to as a jogging station JS, at which location the book block is deposited in the carriage 7, but is not clamped. In the jogging station JS, the pages of the book block are mechanically vibrated or jogged so as to allow the pages to move relative to one another such that the bottom most edges of all of the pages of the book block bear on a horizontal surface 13 and the leading, trailing, and upper edges of the pages are substantially aligned with one another. As previously stated, the lower lengthwise dimension of the book block BB, referred to as the spine S of the book block, rests on the surface 13 of the jogging station JS. The jogging operation is carried out by vibrating the book block in the carriage by an electromechanical vibrating mechanism 15 (as shown in FIG. 6), which has a vibrating magnetic coil (solenoid) 17 connected to the surface 13 by resilient arms 19. The magnetic vibrating coil is energized by a suitable power supply (not shown) under the control of the control system CONT 1. Preferably, during the jogging operation, the carriage clamp 9 is positioned in such manner as to loosely hold the pages P of the book block in vertical positions relative to one another such that they may move relative to one another during the jogging operation to permit the pages to align with one another. During the jogging operation, the pages of the book block are preferably vibrated in such manner that the pages move rearwardly relative to the carriage 7 such that the trailing edges of the pages of the book block contact a vertical surface 21 of the carriage. The vertical surface 21 of the carriage 7 thus provides an accurate reference position for the trailing edge of the book block that is later used to positively position the book block relative to the components of the apparatus as the book block is bound and trimmed. One arrangement for accomplishing this jagging of the book block is shown schematically in FIG. 19. FIG. 19 shows the carriage 7 mounted on a vibrating device comprised of an upper angled block 200 and a lower angled block 202 with the vibrating mechanism 204 mounted between the two blocks. With the angled blocks 200, 202 above and below the vibrating mechanism 204, operation of the mechanism is split into two, perpendicular force components with one component directed upwardly and the other directed horizontally to the left as shown in FIG. 19. Thus, operation of the vibrating mechanism 204 will jog and collate the pages of the book block on the bottom surface 13 of the jogging station JS and against the left vertical surface 21 of the station.

An alternative embodiment of the printing and binding apparatus of the invention is shown in FIGS. 22–25. The alternative embodiment of the printing and binding apparatus incorporates a second, book page printer assembly 200 attached to the printing and binding apparatus I at the opposite end of the work path WP from the first described book page printer assembly 110. In operation, the second, book page printer assembly 200 functions similar to the first book page printer assembly and is configured to print and initially collate the text pages of a book block and to load them into the carriage 7 in substantially the same manner a the first book page printer assembly 110. Use of the second, book page printer assembly 200 increases the production rate of perfect bound books produced by the printing and binding apparatus 1 by effectively cutting in half the time required to print the pages of the book blocks.

The second, book printer assembly 200 comprises a printer 202 and a transfer mechanism 204. The printer 202 of the second, book printer assembly 200 is preferably a black and white printer that is identical to the printer 110 of the first, book page printer assembly described above. It should be understood, however, that the printer 202 of the second, book page printer assembly 200, could be any type of printer, including a color printer if so desired, and need not be identical to the printer 110 of the first, book page printer assembly. The second printer 202 is mounted to the frame 3 of the printing and binding apparatus 1 adjacent the trimming station TS at the opposite end of the work path WP from the printer 110 of the first, book page printer assembly. Like the first, book page printer assembly, the printer 202 of the second, book page printer assembly 200 is preferably mounted to the printing and binding apparatus 1 by a support platform 206 that is attached to the frame 3 of the printing and binding apparatus by a vertically hinged support member 208. In general, the printer 202 of the second, book page printer assembly 200 functions identically to the printer of the first, book page printer assembly.

The transfer mechanism 204 of the second, book page printer assembly 200 comprises a rectangular tray 210 and a support bracket 212. The tray 210 is preferably a mirror image of the tray of the first, book page printer assembly and includes identical features such as a box shaped bin having first 214 and second 216 side walls, a rear wall 218, and a top wall 220, a vibrating mechanism 222 for initial jogging and collating of the printed pages of the book block, and a screw driven clamping arm 224. A shaft 226 is mounted to the support bracket 212 for rotation about the shaft's axis. The tray 210 is mounted on the shaft for rotation with the shaft. Like a mirror image of the shaft 132 of the first, book page printer assembly, the left most end 228 of the shaft 226 of the second, book page printer assembly is oriented slightly above the opposite right end 230 of the shaft such that the shaft and tray 210 are angled slightly from the horizontal.

Figure 23:
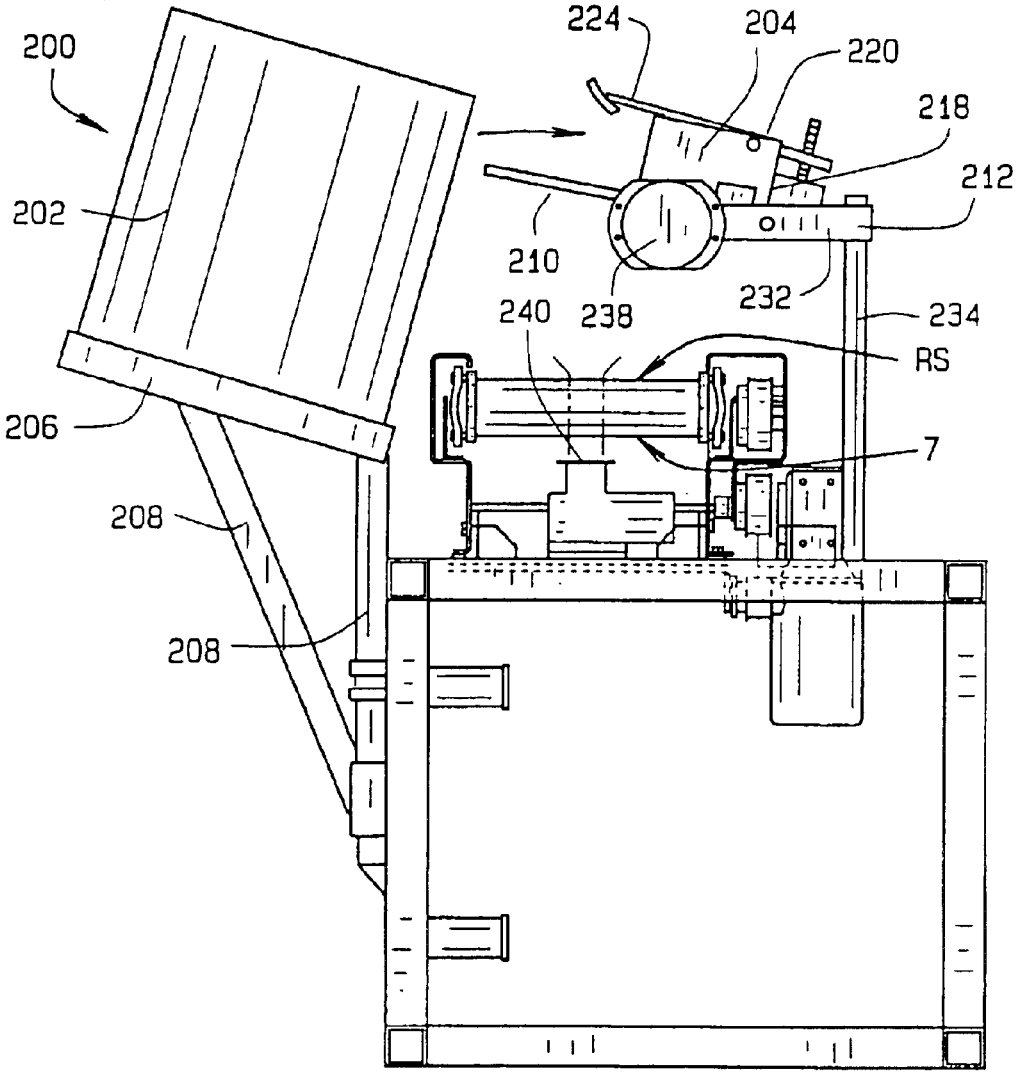
Figure 24:
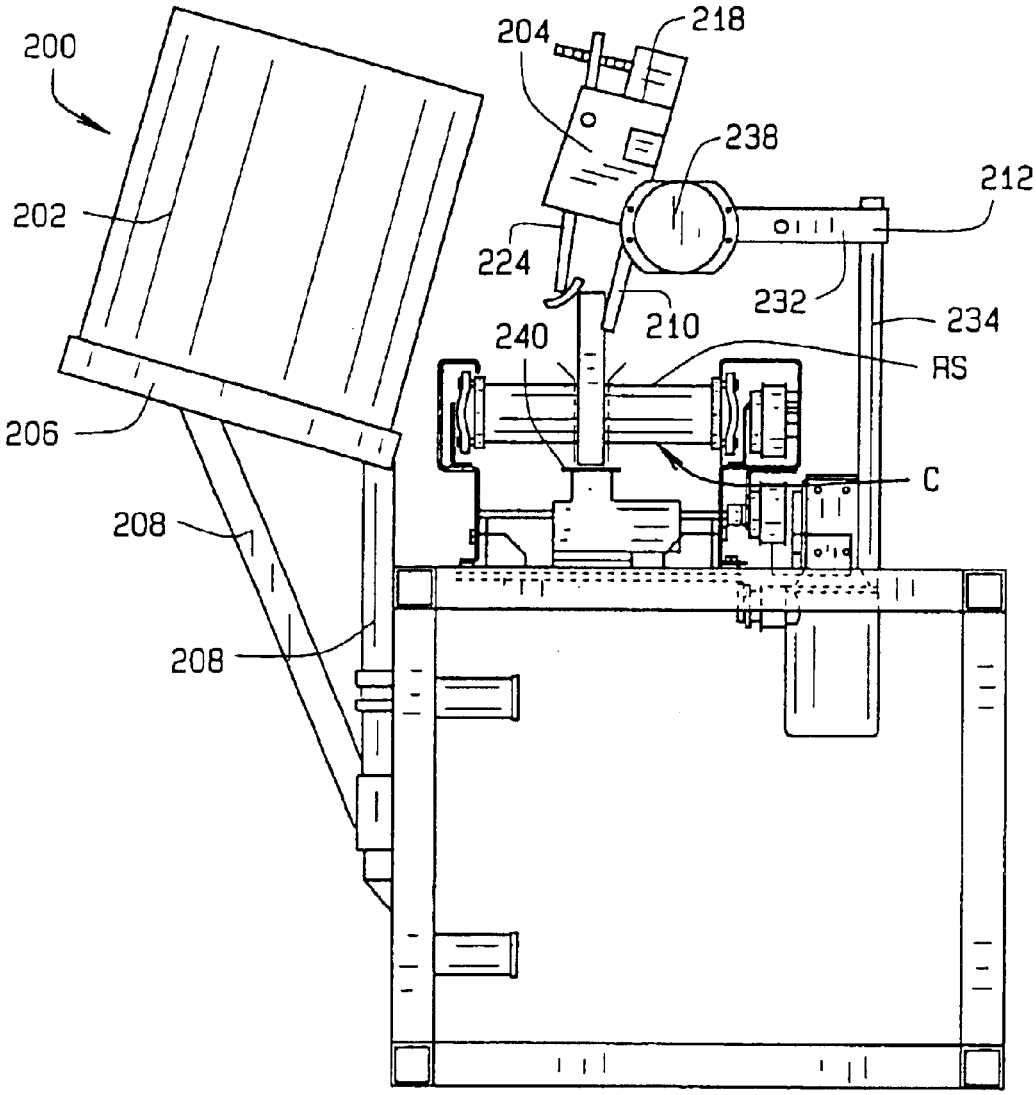
Figure 25:
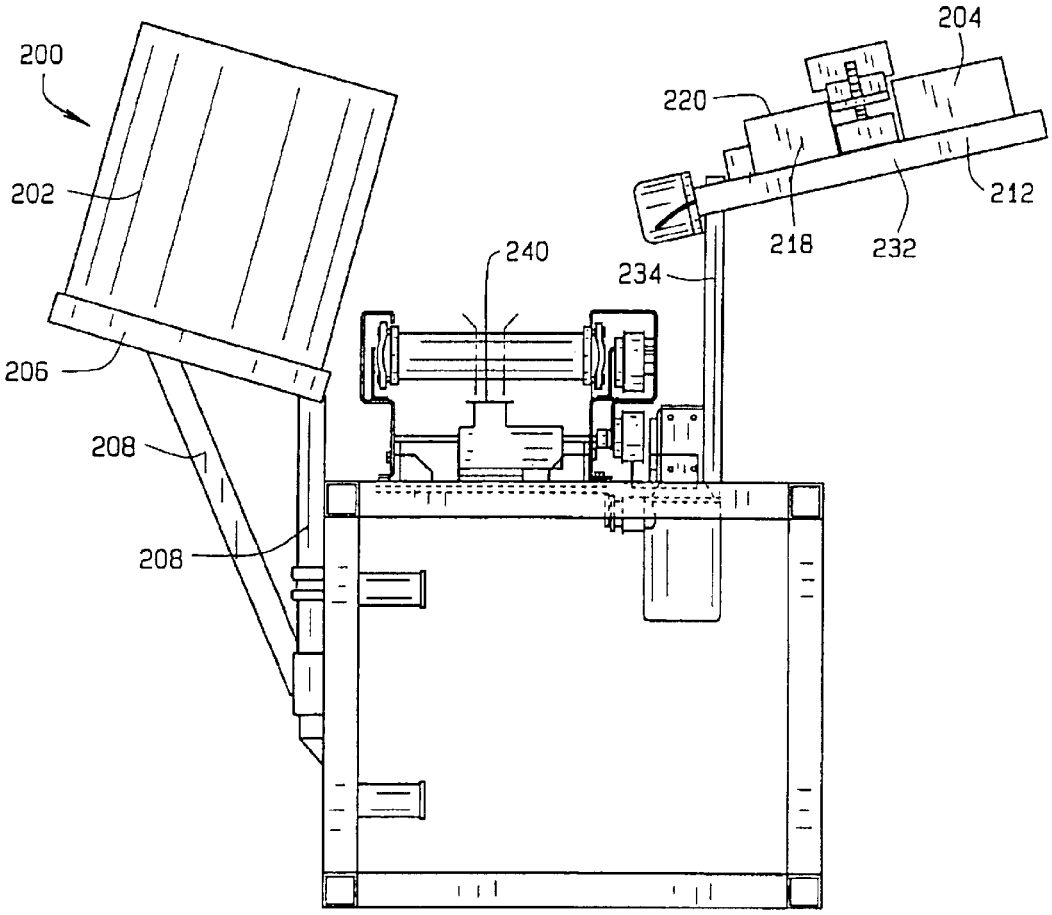

Unlike the transfer mechanism 112 of the first, book page printer assembly, the support bracket 212 of the second, transfer mechanism 204 is constructed with a C-shaped portion 232 of the bracket that supports the opposite ends of the tray shaft 226. The C-shaped portion 232 is mounted to the frame 3 of the printing and binding apparatus 1 for pivoting movement about a vertical axis defined by a main support member 234 of the support bracket. This pivoting connection allows the C-shaped portion 232 of the bracket 212, along with the tray 210 mounted thereto, to swing between an operational position, as shown in FIG. 22–24, and a maintenance position, as shown in FIG. 25. In the maintenance position the transfer mechanism 204 is easily accessed for servicing and the trimming station TM beneath the transfer mechanism is also more easily accessed for servicing. A locking mechanism 236 is provided for releasably securing the C-shaped portion 232 of the bracket 212 in the operational position.

Due to the pivoting movement of the tray 210 and the C-shaped portion 232 of the support bracket 212 with respect to the printing and binding apparatus 1, the rotation of the tray shaft 226 with respect to the C-shaped portion of the support bracket is driven by an alternating current tray shaft drive motor 238 that is mounted directly to the C-shaped portion of the support bracket such that it can pivot therewith. When the C-shaped portion 232 of the support bracket 212 is in the operational position, the tray shaft drive motor 238 can be operated by the control system CONT 1 to selectively rotate the shaft, together with the tray 210, between a printed page receiving position shown in FIG. 23 and a book block depositing position shown in FIG. 24.

In operation, the transfer mechanism 204 of the second, book page printer assembly 200 operates in a similar manner to the transfer mechanism 112 of the first, book page printer assembly. Thus, the transfer mechanism 204 receives pages from the printer 202 of the second, book page printer assembly 200 with the tray 210 in the printed page receiving position, initially jogs and collates the printed pages of a book block, clamps the printed book block on the tray, rotates the tray to its book block depositing position, and releases the book block to allow the book block to fall into the carriage 7, in the same manner as described above in reference to the first, book page printer assembly. It will be understood that the tray 210 will only deposit the pages P for the second book block in carriage 7 when the carriage is in a second receiving station RS, as shown in FIGS. 23 and 24.

Unlike the transfer mechanism 112 of the first book page printer assembly 110, the transfer mechanism 204 of the second book page printer assembly 200 rotates the tray 210 to its book block depositing position and releases the book block into the carriage 7 when the carriage is at its receiving station RS the opposite end of the work path WP, adjacent the trimming station TS. Just prior to this point, the carriage 7 has deposited a bound book into the nest 41 of the trimming station TS and is therefore empty.

A horizontal positioning plate 240 is mounted to the printer binding apparatus 1 in a position aligned with the tray of the second transfer mechanism 204 and just beneath the carriage 7 when the carriage is positioned beneath the transfer mechanism 204 of the second, book page printer assembly 200 as shown in FIGS. 23–25. When a book block is deposited into the carriage 7 from the transfer mechanism 204 of the second, book page printer assembly 200, the spine of the book block is supported on the positioning plate 240 and then the clamping members 11*a*, 11*b* of the carriage 7 are moved together to firmly hold the book block. The positioning plate can also be provided with vertically extending sides positioned outside and below the clamping members 11*a*, 11*b* of the carriage 7 to prevent pages of the book block from slipping off of the positioning plate. The positioning plate 240 is at an elevation above that of the horizontal plate 13 of the jogging station JS such that a book block deposited into the carriage 7 by the second, book page printer assembly 200 is positioned higher in the carriage than a book block deposited into the carriage by the first, book page printer assembly. Thus, the positioning plate 240 serves to establish the vertical orientation of the book block as the book block is moved by the carriage 7 back along the work path WP to the jogging station JS at the opposite end of the work path. Positioning the book block higher in the carriage 7 prevents the book block from contacting any components of the various work stations as it is brought to the jogging station JS.

Once the carriage 7 arrives at the jogging station JS with the book block printed by the second, book page printer assembly 200, the clamping members 11*a*, 11*b* of the carriage 7 are released to allow the book block to drop onto the horizontal surface 13 of the jagging station JS. From this point, the pages of the book block are jogged and the book binding process proceeds in the same manner as it would if printed by the first book page printer assembly as described above.

Thus, by incorporating the second, book page printer assembly 200 in the additional embodiment of the printing and binding apparatus of the invention, the production rate of perfect bound books can be increased by alternating the feeding of the carriage with a book block printed by either of the first and second, book page printer assemblies. The increased production rate should be apparent in situations where the printing of a book block requires more time than it takes the carriage 7 to move along the work path from the jogging station JS to the opposite end of the work path and then return to the jogging station during the production of a perfect bound book. This is often the case when the books being bound have large numbers of pages. Incorporating the second, book page printer assembly 200 in the additional embodiment of the printing and binding apparatus also allows the printing and binding apparatus to continue production of perfect bound books when either of the printers of the first and second, book page printer assemblies is being serviced. It will be understood that the different books printed by the page printers 110 and 200 may be of different sizes and thickness.

As mentioned above, the second, book page printer assembly 200 is positioned adjacent the trimming station TS which periodically requires maintenance. To perform such maintenance, it is helpful to have access to the trimming station TS from above. This is why the C-shaped portion 232 of the support bracket 212 is pivotable about the main support member 234 of the support bracket between the operational position and the maintenance position. As best shown in FIG. 22, the main support member 234 of the support bracket 212 is positioned adjacent the rear and right side of the C-shaped bracket 232. By releasing the locking mechanism 236, the C shaped portion 232 of the support bracket 212 and the tray 210 can be pivoted about the main support member 234 into the maintenance position as shown in FIG. 25. With the C-shaped portion 232 of the support bracket 212 and the tray 210 in the maintenance position, the top of the trimming station TS can be easily accessed for maintenance. Finally, when such maintenance is complete, the C-shaped portion 232 of the support bracket 212 and the tray 210 can be quickly pivoted back into the operational position and the printing and binding apparatus returned to production.

Figure 33:
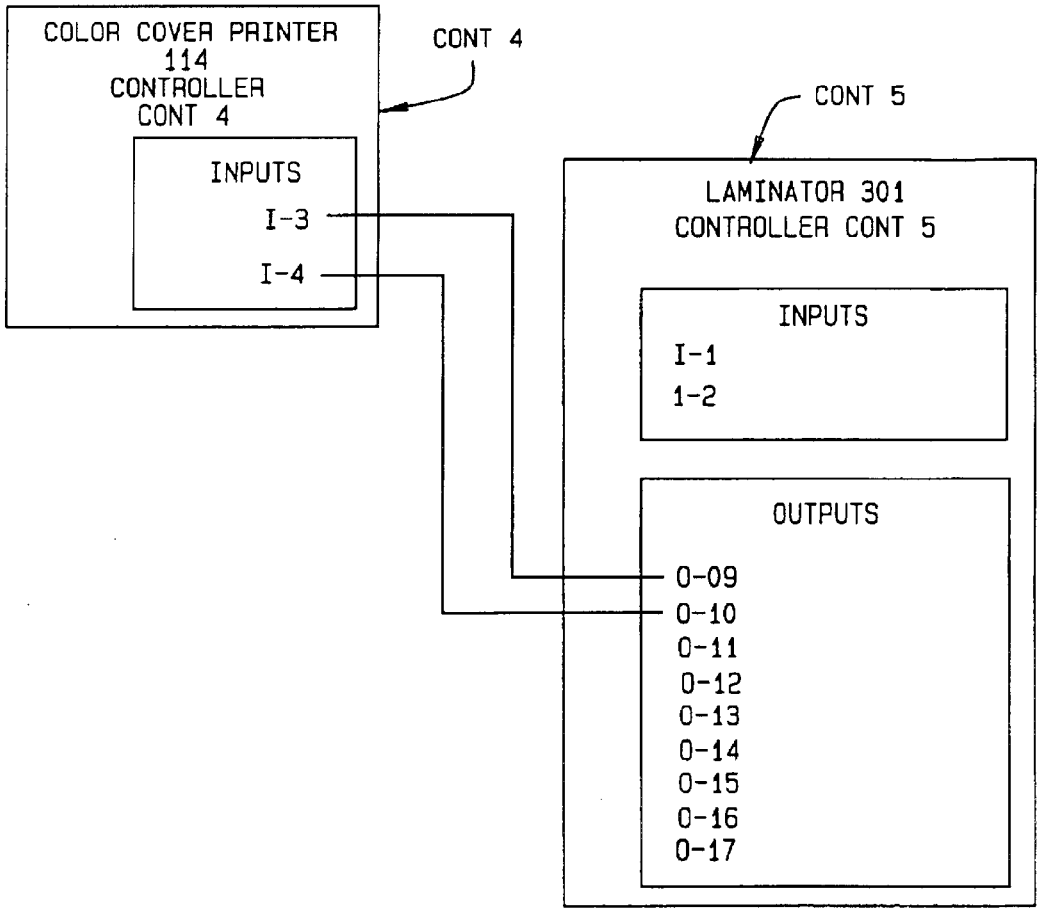
FIG. 33 is a block diagram of a portion of the control system shown in FIG. 32 illustrating how the controller for the lamination station cooperates with the controller for the color cover printer.

In accordance with the present invention, apparatus 109 or 200 may be provided with a laminating station 301 for applying inner and outer laminations IL and OL to the inner and outer faces of cover C as the cover is printed by color printer 114 before the cover is bound to its respective book block BB at binding stating BS. This allows a perfect bound book B printed on demand by apparatus 109 or 200 to have a double laminated cover DLC. Preferably, lamination station 301 may be added on to the on demand book publishing system shown in FIGS. 14–25 by positioning the lamination system as shown in FIG. 26 and by connecting the lamination control system CONT 5 to the book publishing system control system, as shown in FIGS. 33 and 34, and as will be described hereinafter.

Figure 27:
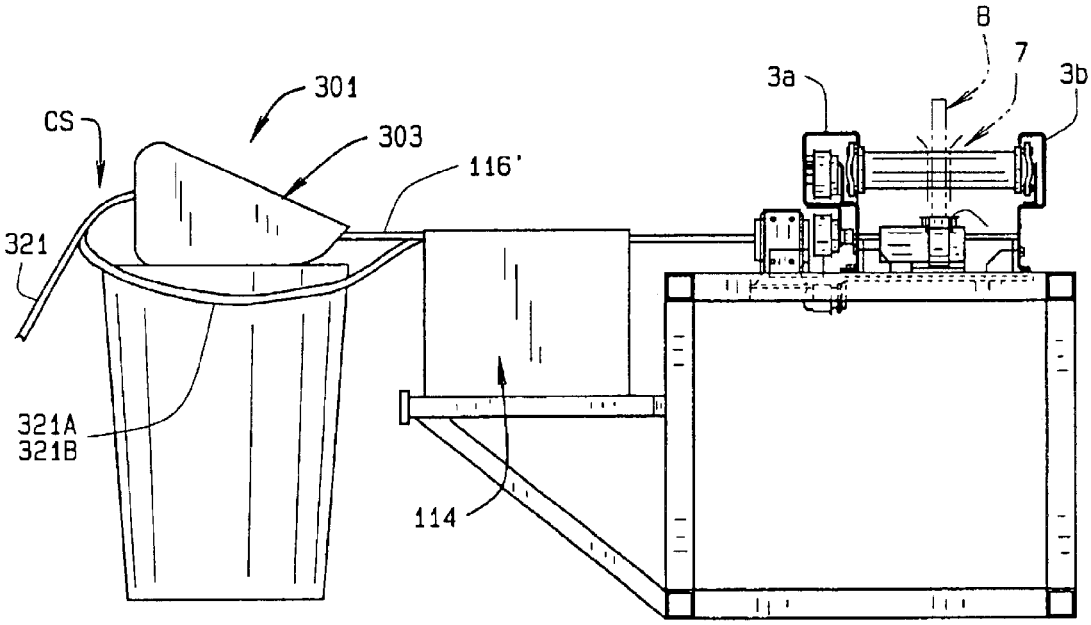
FIG. 27 is a cross sectional view taken along line 27—27 of FIG. 26 illustrating in side elevation a color cover printer, the cover transporting conveyor, the lamination station, and the cover conditioning station.
Figure 26:
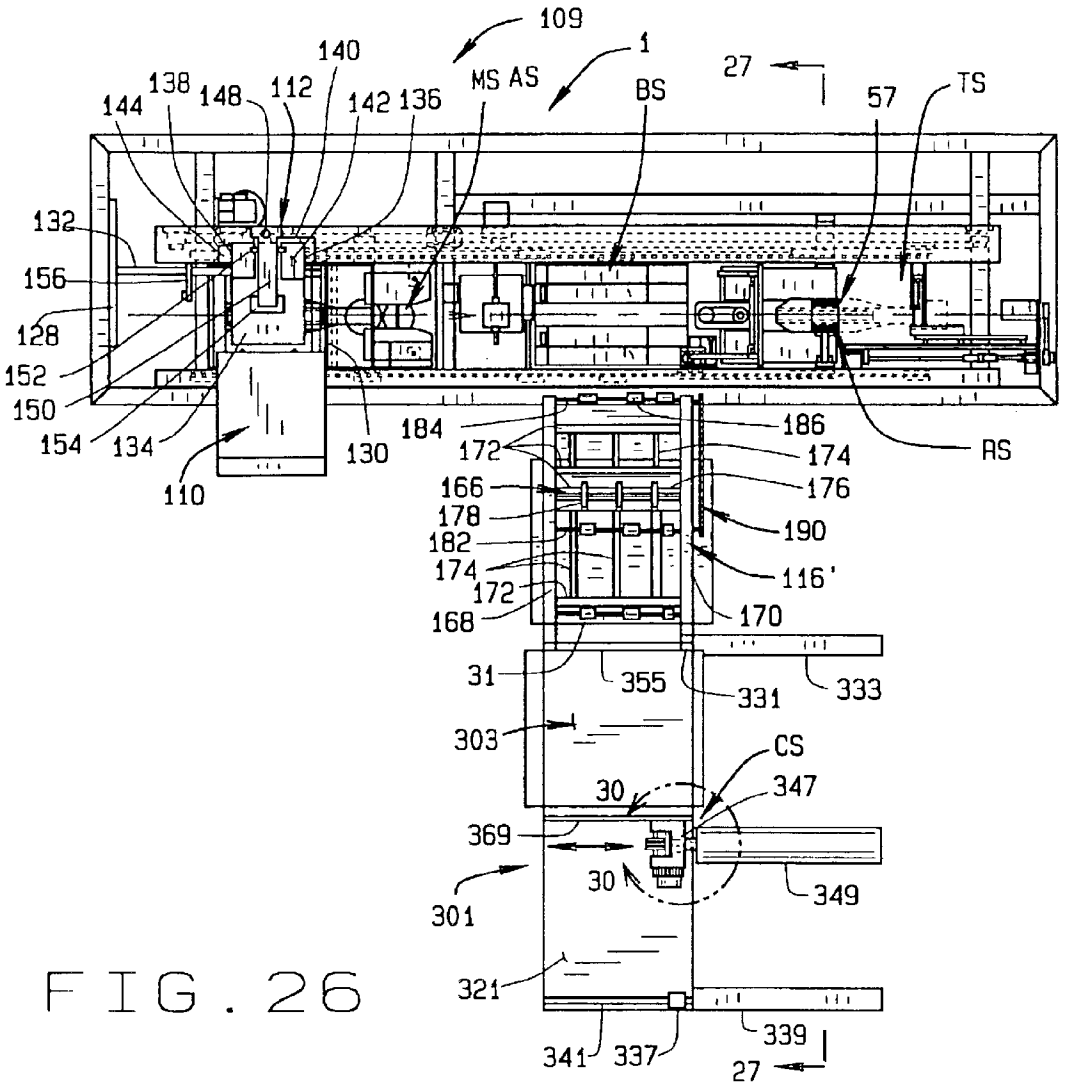
FIG. 26 is a top plan view of apparatus of the present invention (referred to as a lamination station) for double laminating a cover for an on demand printed book, with FIG. 26 corresponding generally to FIG. 15, but having a cover lamination station in line with a conveyor or mechanism for transporting a cover printed by a cover printer to the lamination station for having the outer and inner laminations adhered to the inner and outer faces of the cover and illustrating a cover conditioning station for conditioning a center portion of the inner face of the inner lamination to be adhered by the adhesive to the spine of the book block, with the cover transporting mechanism or conveyor conveying the double laminated cover from the lamination station to a binding station of the binder/trimmer apparatus shown in FIGS. 5–13.

As shown in FIGS. 26 and 27, the color printer 114 of apparatus 109 is provided with lamination station 301 to receive the cover C printed by color printer 114 as the cover is ejected from the color printer. More particularly, the cover conveyor 116 has been modified to convey the cover C from cover printer 114 to the lamination station. The modified cover conveyor is indented at 116' in FIGS. 26–28. The lamination station includes a laminator, as generally indicated at 303, for laminating the inner and outer laminations IL and OL to the inner and outer faces of cover C as the latter is conveyed through the laminator 303 thereby forming a double laminated cover DLC. The laminator 303 may be a conventional film laminator, such as GBC Eagle 35 laminator, commercially available from GBC Corporation of Chicago, Ill., capable of laminating both sides of a piece of stock (i.e., cover C) fed through the laminator. Such laminators typically have a pair of feed rolls 305A, 305B for holding a web of lamination film, one for applying a lamination film 307A so as to constitute outer lamination OL on one side (e.g., the outer face) of cover C and the other for applying a lamination film 307B so as to constitute the inner lamination IL on the other side (e.g., the inner face) of the cover. As the lamination film is unrolled from the feed rolls 305A, 305B, each film passes around a respective heater roll 309A, 309B to heat the film and to activate an adhesive applied to the face of the film that will be adhered to its respective face of cover C. The cover C and the lamination films 307A, 307B pass between the nip of heated rolls 309A, 309B the lamination films are firmly pressed onto the respective inner and outer faces of the cover C so as to smoothly laminate the cover within the inner and outer laminations. It will be understood that as is conventional, by heating the films prior to application to cover C, not only is the adhesive on the one face of the film activated, but the heating tends to at least partially heat shrink the film so as to substantially eliminates folds and wrinkles of the film on the cover such that the laminations are smooth. Preferably the lamination film is clear (transparent), but it will be understood that any lamination film could be used. It will also be understood that the lamination film may have imprinting, designs, logos, colors or the like imprinted thereon. An additional pair of compression rolls 311A, 311B is provided so that as the cover and the inner and outer lamination films 307A, 307 b pass through the nip of rolls 311A, 311B, the film is further pressed onto both sides of the cover. It has been found that the above-described HiTac lamination film commercially available from GBC Corporation works well, but it will be understood that any suitable lamination film may be used. This laminator has its own drive motor (not shown) for driving rolls 309A, 309B and 311A, 311B and is readily controlled by controller CONT 5 as hereinafter described.

Figure 32:
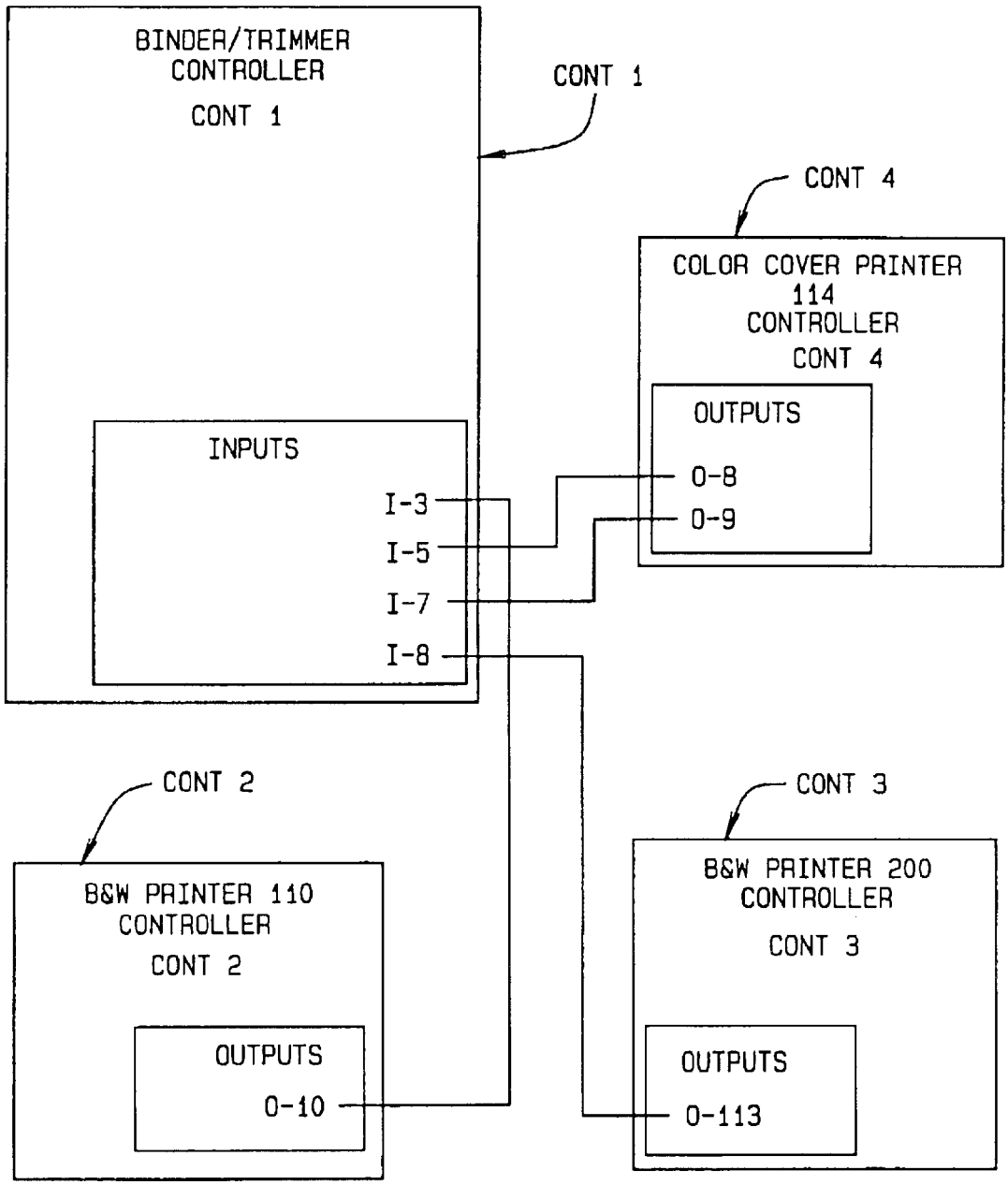
FIG. 32 is a block diagram of the control system for controlling operation of the apparatus of the present invention including control of the laminations station for double laminating a cover.

Referring to FIGS. 26 and 27, it is seen that the cover transfer mechanism 116 has been modified, as indicated by reference character 116', for transferring a cover printed by the cover printer 114 to lamination station 301 and for receiving a double laminated cover from the lamination station for being delivered to binding station BS. Specifically, an additional set of reversible drive rolls 313A, 313B driven by a motor LM1, preferably a reversible stepper motor, is provided at the outer ends of channels 168, 170 to feed the cover as it is carried from printer 114 by the cover transfer mechanism to the lamination station 301 and, after the cover C has been laminated, for transferring the cover from the lamination station back to the cover transfer mechanism 116' for transporting the laminated cover to binding station BS so as to be adhered to its respective book block BB in the manner heretofore described. As will be described, motor LM1 is operated under the control of a lamination controller CONT 5C, as shown in FIGS. 32 and 33.

Figure 28:
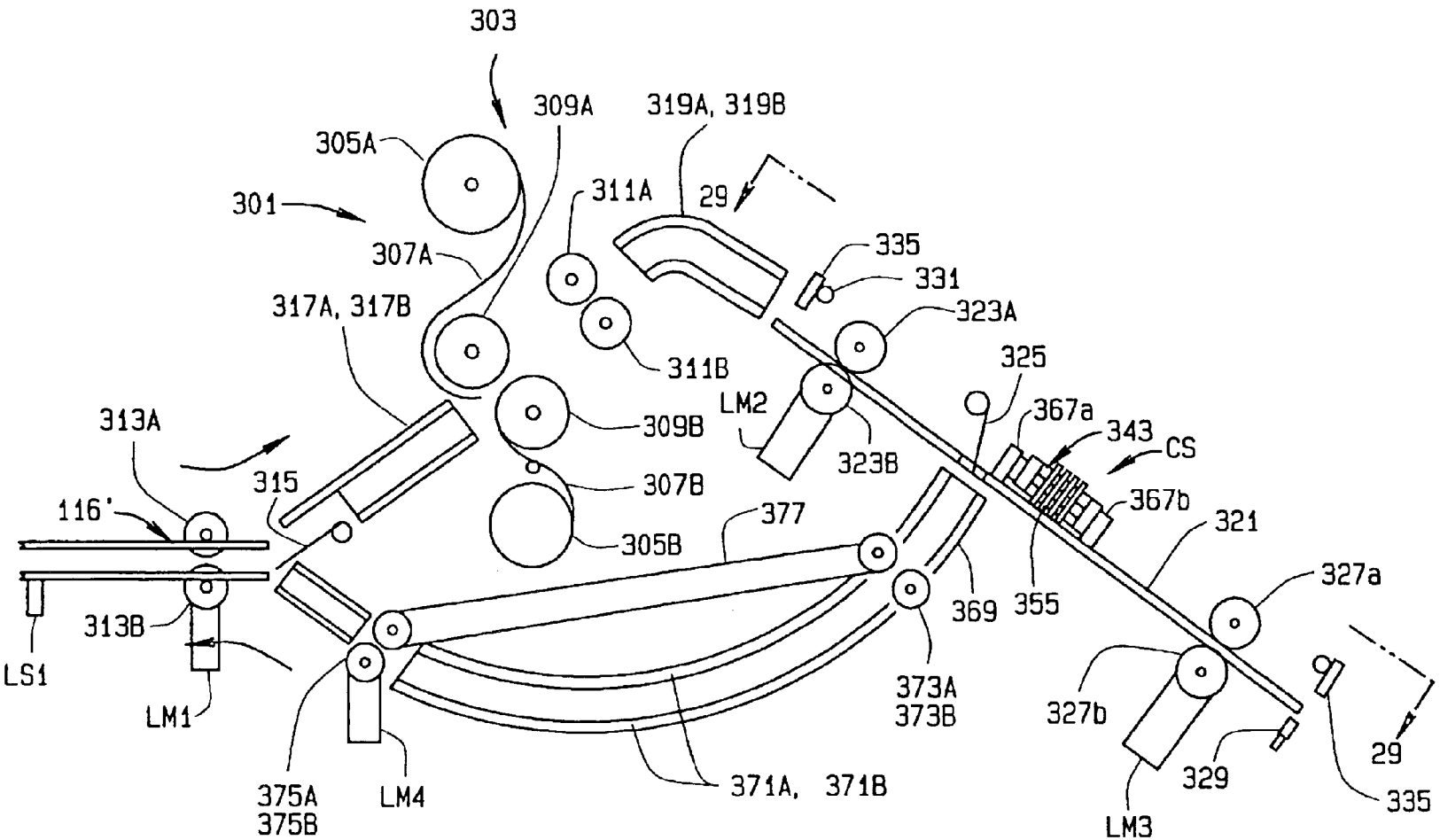
FIG. 28 is a side elevational schematic view of a portion of the cover transporting conveyor, of the lamination station, of the conditioning station, and of a conveyor for transporting a conditioned double laminated cover from the conditioning station to the binding station.

As shown best in FIG. 28, the right-hand or leading edge of cover C encounters a cover sensor LS1 which signals lamination controller CONT 5 that a cover C is being ejected from cover printer 114 for being laminated. The cover encounters a gravity operated diverter 315 as the cover is fed out of the cover transfer mechanism 116' by drive rolls 313A, 313B. Diverter 315 is gravity biased so as to be in a first position, as shown in FIG. 28, so as direct the leading edge of cover C upwardly into laminator 303. The laminator 303 is operated under the control of lamination controller CONT 5. As will appear, after the cover C has been laminated and is conveyed back to the cover transfer mechanism, the diverter 315 is movable by the cover to a second or raised position so as to direct the cover into the nip of reversible drive rolls 313A, 313B. A pair of spaced guide channels 317A, 317B receive lateral edges of cover C from diverter 315 as the cover is fed into the laminator 303. The guide channels 317A, 317B direct the leading edge of the cover between the heated rollers 309A, 309B so that the inner and outer laminations IL and OL are applied to the inner and outer faces of the cover. The cover C with the lamination films adhered to both of its faces then passes between rolls 311A, 311B so as to more firmly press the lamination film onto the inner and outer faces of the cover. The lateral edges of the now double laminated cover DLC encounter curved, spaced guide channels 319A, 319B to direct the leading edge of the cover downwardly toward a cover conditioning station CS.

Figure 29:
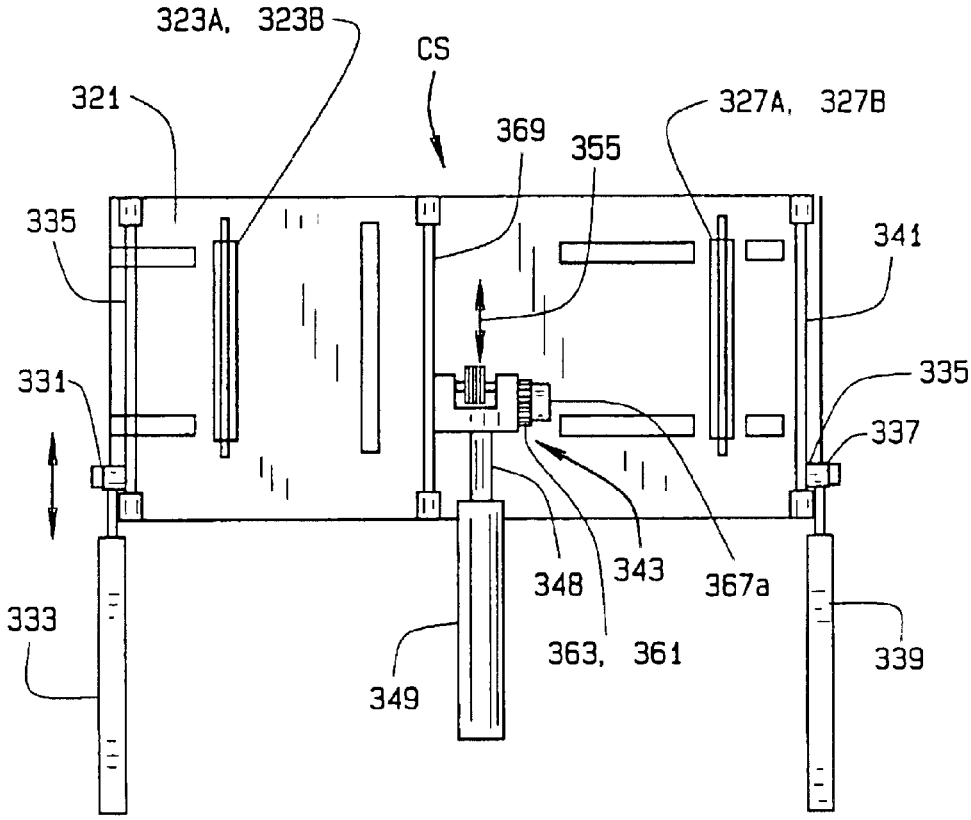
FIG. 29 is view of the conditioning station taken along line 29—29 of FIG. 28.

As the double laminated cover DLC exits guide channels 319A, 319B, it is fed onto an inclined table or bed 321 and between another pair of reversible drive rolls 323A, 323B driven by a reversible stepper motor LM2 under the control of laminator controller CONT 5. As the leading edge of the cover exits rolls 323A, 323B, it encounters another gravity operated diverter 325 which allows the cover to be fed down the slope of table 321. The cover DLC is maintained under the control of drive rolls 323A, 323B while it is on the table and thus the position of the cover on the table is "known" to the laminator control system CONT 5. As the cover continues to be fed down table 321, it passes under a cover conditioning station CS and encounters still another set of reversible drive rolls 327A, 327B. These last-mentioned drive rolls are driven by a stepper motor LM3 under the control of the laminator control system CONT 5. A photo sensor positioning sensor 329 is provided at a predetermined location along table 321 such that when the cover C moves over sensor 329, a signal will be generated indicating to the laminator controller CONT 5 that the leading edge of the cover is in a desired position on the table. The laminator controller CONT 5, having the dimension information corresponding to the cover C being laminated, then activates motor LM3 to as to accurately position the center portion CP of the cover C relative to the conditioning station CS. A rear trimming knife 331 is actuated by a respective knife air cylinder 333 (see FIG. 29) to move a razor knife transversely along its track 335 across the width of the cover at its trailing edge thereby to cut the inner and outer laminations 307A, 307B from rolls 305A, 305B. With the cover DLC properly positioned on table 321, a leading edge knife 337 is actuated by its respective air cylinder 339 to move a razor knife along its track 341 across the width of the cover at its leading edge so as to trim any excess lamination film from the leading edge of the cover.

Figure 30:
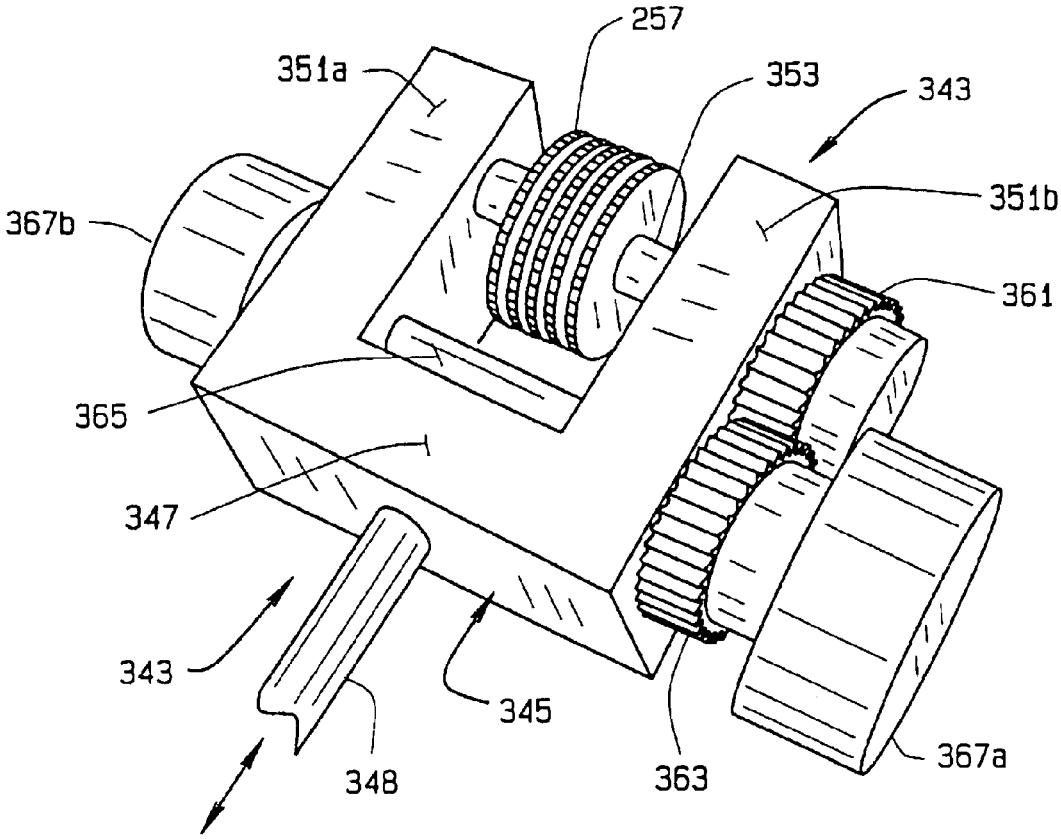
FIG. 30 is a perspective view of the a conditioning roller for scarifying the center portion of the inner lamination of the cover at the conditioning station.
Figure 31:
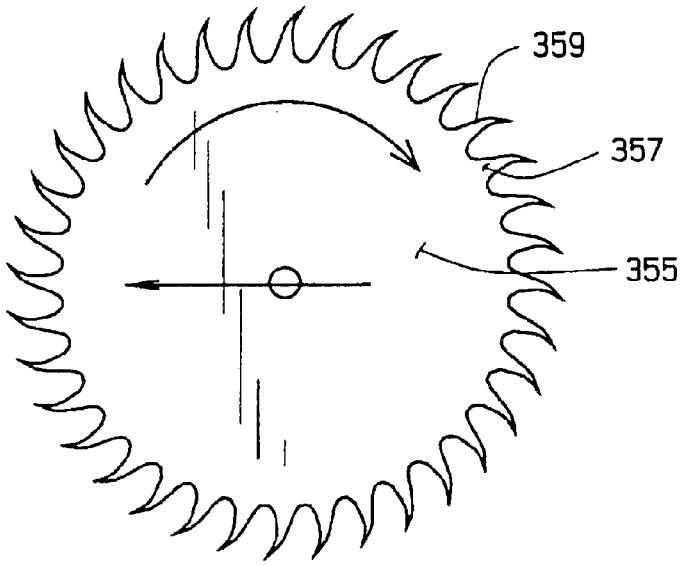
FIG. 31 is an enlarged side elevational view of one of the discs comprising the conditioning roller.

Cover conditioning station CS preferably comprises a roughening or scarifying roller 343 movable transversely across the center portion CP of the laminated cover C positioned on table 321 so as to condition the center portion CP of cover C (and more particularly the center portion of the inner lamination IL) so that the adhesive A more readily bonds (grips) to the inner lamination IL. As shown in FIG. 30, the roughening or scarifying roller 343 comprises a frame or yoke 345 having a base portion 347 connected to an actuator rod 348 of a linear actuator (e.g., an air cylinder) 349. The yoke 345 has two spaced fingers 351*a*, 351*b* which journal an arbor shaft 353. A plurality of toothed wheels or discs 355 are non-rotatably mounted on shaft 353. Preferably, the wheels or discs 355 are ganged on the shaft 353 so that the width of the ganged wheels ranges from about ½ to about 1½ inches (1.25 cm. to about 3.7 cm.). As shown in FIG. 31, each toothed wheel or disc 355 is larger in diameter than the thickness of yoke 345 and each wheel has a plurality of sharp teeth 357 with each tooth having a hooked outer point 359. The wheels or discs 355 are generally parallel to one another as they are mounted on shaft 353 and the points 359 of the wheels bear on the inner lamination film 307A adhered to the outer face of the center portion CP of cover C. The roller is selectively movable upon actuation of its cylinder 349 (see FIG. 29) between a retracted position (as shown in FIG. 26) in which the toothed wheels are clear of a lateral edge of cover C positioned on table 321 and an extending position in which the rollers are moved laterally across the full width of the cover at the conditioning station to the far lateral edge of the cover. As shown best in FIG. 30, shaft 353 has a pinion gear 361 affixed to one end. This pinion is in mesh with a drive gear 363 mounted on a drive shaft 365 journalled in yoke 345. The ends of shaft 365 extend beyond the yoke and a friction drive wheel 367*a*, 367*b* is mounted on each end of the shaft. These friction drive wheels are preferably of a material such as a suitable rubber so as to have a relatively high coefficient of friction when in contact with the outer face of the inner lamination IL on cover C at the conditioning station CS. A guide track 369 (see FIG. 29) may provided at the conditioning station for guiding the yoke 354 as it is reciprocated across the cover by its cylinder 349 and for maintaining the points 359 of teeth 357 in contact with the inner lamination IL. As may be preferred, track 369 may cooperate with yoke 354 in such manner that the points 359 are forced downwardly onto the inner lamination IL as the yoke is reciprocated across the cover so as to insure that the points penetrate through the inner lamination and into cover C. It will be understood that as the yoke is reciprocated by cylinder 349, friction rollers 367*a*, 376*b* roll on the cover C and in turn, via drive gear 363 and pinion 365, counter-rotate shaft 353 and wheels or discs 355 in the opposite direction of drive wheels 367*a*, 367*b*. With the points 359 in contact with the inner lamination IL of laminated cover C and with the wheels 355 so counter-rotated as the yoke 345 is reciprocated across the width of the cover by cylinder 349, it will be appreciated that the points puncture through the inner lamination IL and tear (roughen) the inner lamination forming slits or cuts (or partial slits or cuts) SL therein thus opening or exposing the inner lamination in the area of the cuts or slits such that the adhesive A will better adhesively bond to the roughened surface of the inner lamination and directly with cover C in the areas exposed by slits or cuts through the inner lamination.

Figure 4:
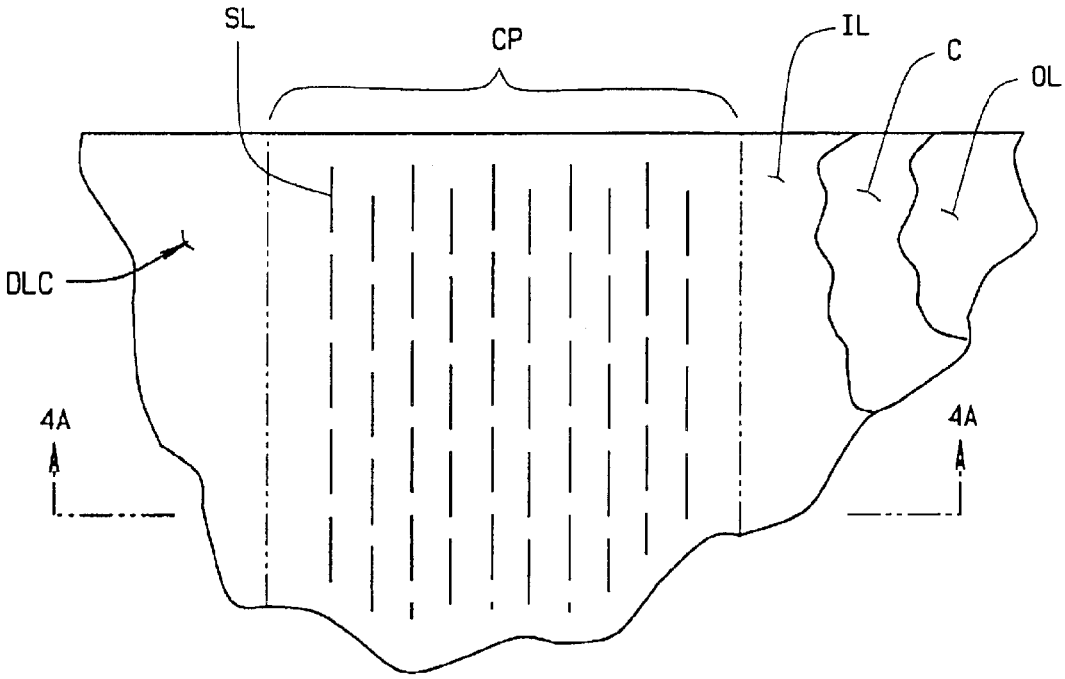
FIG. 4 is an enlarged partial view taken along line 4—4 of FIG. 3 showing the central portion of the inner lamination adhered respectively to the inner face of the cover with the inner lamination conditioned to facilitate adhesive binding with the spine of the book block in accordance with this invention, such conditioning being shown as a multiplicity (many) of cuts, slits or punctures (which may be of varying lengths) formed through the inner lamination with portions of the inner lamination proximate such cuts, slits or punctures being pulled up from the plane of the inner lamination so as to roughen the center portion of the inner lamination of the cover.
Figure 4A:
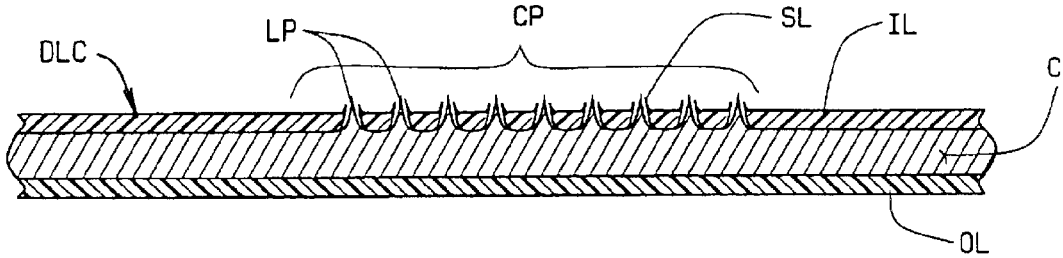
FIG. 4A is an enlarged cross section view taken along line 4A—4A of FIG. 4 illustrating the cuts or slits formed in the inner lamination upon conditioning of the center portion of the cover in accordance with this invention wherein portions of the inner lamination proximate the slits or cuts or punctures formed therein upon conditioning of the inner lamination are raised or pulled up from the surface of the inner lamination and where substantially no indentation or other marks are formed on the outer surface of the cover or on the outer lamination.

As shown in FIGS. 4 and 4A, as the points 359 of the teeth 357 penetrate through the inner lamination IL and into the paper cover C, and as they are counter-rotated, the points pull up portions LP of the inner lamination film adjacent the slits or punctures SL formed by the points thus roughening the surface of the inner lamination IL in the region of the center portion CP of the cover which is positioned at the conditioning station. These pull up portions LP are generally non-uniform and have a roughened appearance. They generally are of varying heights. It will be understood that cylinder may be actuated several times such that the roller 343 repeated moves across the cover and so that the wheels or discs repeatedly roll over the cover. It will also be understood that if the width of the center portion CP of the cover to be conditioned is wider than the width of the ganged discs 355, power driven reversible rolls 327*a*, 327*b* may be operated through the control system CONT 5 which "knows" the thickness of the book to be bound and thus "knows" the width of the center portion CP to be conditioned so as to incrementally advance cover relative to the conditioning station such that the entire center portion is properly conditioned. This roughening of the cover may be referred to as scarifying the inner lamination film IL by making scratches or small cuts SL through the lamination film. In addition to pulling up portions of the film adjacent the cuts or scratches formed by the points 359 on wheels 355, the points also partly penetrate into the paper cover C and in some instances may pull fibers from the cover up into the cuts or scratches as the points roll out of the cover. However, the points do not penetrate through cover C or leave indentations in the outer lamination OL. It will be appreciated that by so roughening the cover, the adhesive A more readily will mechanically grip the inner lamination IL and will thus form a good bond with the inner lamination even though the adhesive may not effectively adhere to the unconditioned lamination film.

Once the double laminated cover DLC has been conditioned, drive rolls 327A, 327B are driven so as to move the trailing edge of the cover past diverter 325. When the trailing edge moves past diverter 325, the diverter will shift to a raised position. Then the drive rollers 327A, 327B via motor LM3 driven in reverse direction. As the upper or trailing edge of the cover encounters diverter 325, the trailing edge of the cover is diverted downwardly out of the plane of table 321 into a slot 369 in the table and into a pair of curved guide channels 371A, 371B. As the cover is driven through the guide channels 371A, 371B by rollers 327A, 327B, the trailing edge (now the leading edge) of the now laminated cover enters the nip of another set of drive rolls 373A, 373B and enters another pair of guides 373A, 373B and 375A, 375B. These last-mentioned drive rolls are driven by a gear motor (or the like) LM 4 and are driven together by a chain and sprocket (or other suitable drive), as indicated at 377. From there, the trailing edge of the cover (now serving as the leading edge) moves into the nip of drive rolls 313A, 313B which are now driven in reverse direction to convey the now laminated cover back onto the cover transport mechanism 116'.

The cover transport mechanism 116' then transports the laminated cover to the binding station BS in the same manner as heretofore described so as to accurately position the cover at the binding station such that the center portion CP of the cover is in register with spine of a book block BB carried by carriage 7. Thus, upon actuation of the clamp 35 at the binding station BS, the cover C will be drawn up on the spine S and will be tightly wrapped around the spine such that the adhesive carried by the spine will engage the roughened (scarified) center portion CP of the inner lamination IL adhered to the cover C. As noted the adhesive will thus effectively mechanically bond to the roughened film and will result in a perfect bound book with a double laminated cover with the book block/cover bond having a strength generally the same as or better than the bond between the book block and a non-laminated cover.

Figure 12:
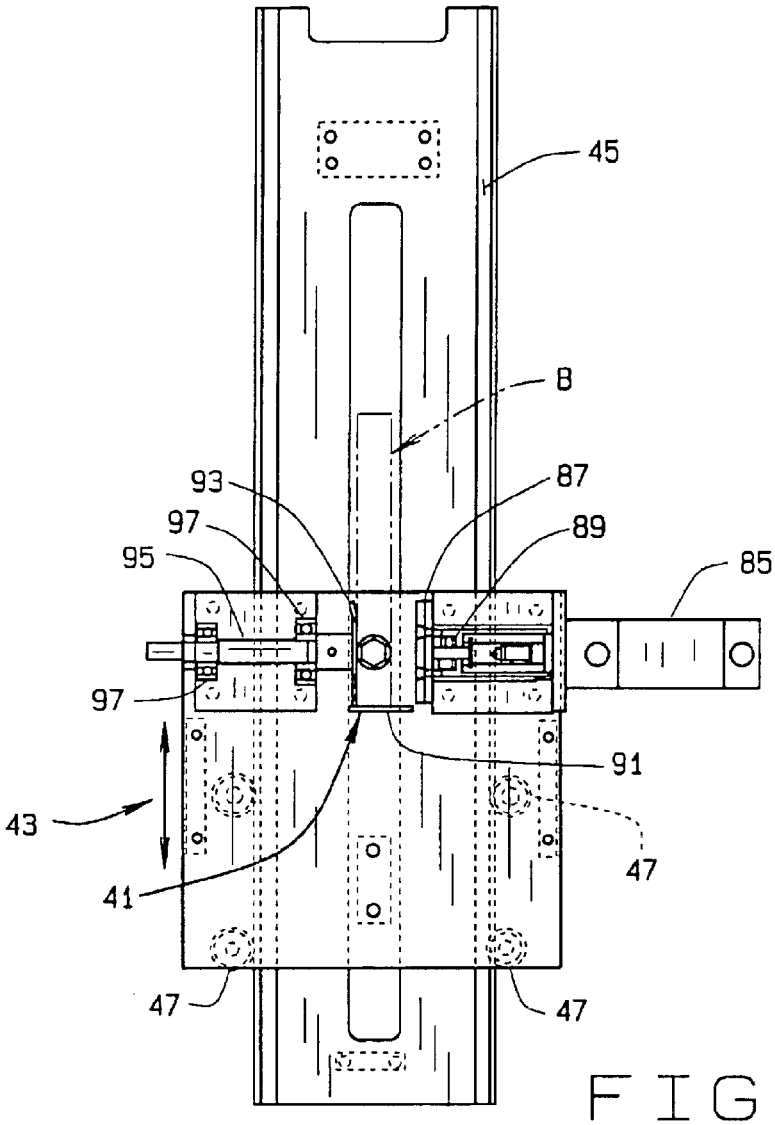
Figure 13:
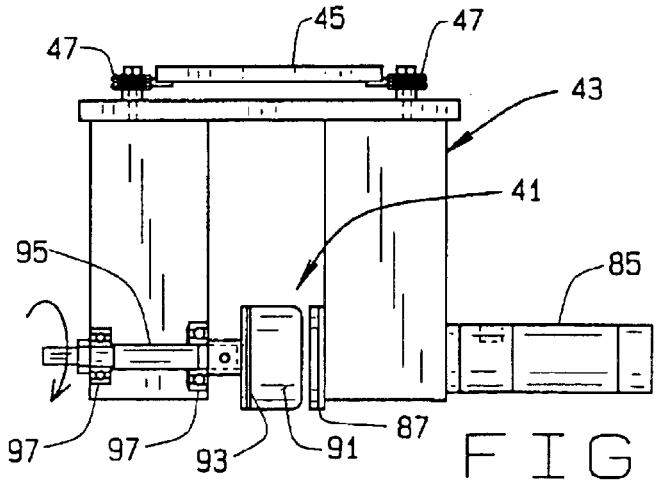

The control system for controlling operation of the printing, binding and trimming apparatus, as shown generally in FIGS. 14–25, is described in the aforementioned U.S. Provisional Patent Application No. 60/281,524, now U.S. Non-Provisional patent application Ser. No. U.S. 2002/0064436 A1, published May 30, 2002 which is herein incorporated by reference. In brief, this control system includes a binder/trimmer controller CONT 1, as shown in FIG. 32. CONT 1 is preferably a programmable controller, such as an AT6400 controller, as described in the aforementioned U.S. Pat. No. 6,193,458 and as illustrated in FIG. 12 thereof. The controller CONT 1 for the printing, binding and trimming apparatus, as shown in FIGS. 14–25, in turn controls operation of the black and white printer 110 via a controller CONT 2 and of operation of black and white printer 200 via a controller CONT 3. Operation of color printer 114 is controlled by a fourth controller CONT 4. For example, controllers CONT 2–4 may be model RPC-150 programmable controllers commercially available from Remote Processing Corporation, 7975 E. Harvard Avenue, Denver, Colo. 80231.

In accordance with this invention, the lamination station 301 is a feature that may be added on to the printer, binder, trimmer apparatus shown in FIGS. 14–25 if it is desired to produce perfect bound books having double laminated covers DLC. If the lamination station 301 is to be employed, another controller CONT 5 is connected to the cover printer controller CONT 4, as shown in FIG. 33. Again, this controller CONT 5 may also be a model RPC-150 programmable controller.

It will be understood that a digital library of books to be printed on demand including the text pages and covers of such books are stored in a suitable electronic format (e.g., in PDF or in a TIFF format) on a digital computer or book server. Upon commanding the apparatus 1 to print and bind a selected book on demand, the text pages and the cover for the selected book are retrieved from the digital database and transferred to the black and white text page printers 110 or 200 and the cover information is transmitted to the color cover printer 114. In addition, information concerning the format, size, and number of pages are made known to the controller CONT 1 such that the book being trimmer can be properly bound and trimmed to result in a perfect bound book of predetermined size. In accordance with this invention, if it is desired to provide the book being printed on demand with a double laminated cover DLC, the lamination station 301 will be utilized to apply inner and outer laminations IL and OL to the cover before the cover is transferred to the binding station BS of the binder/trimmer 1.

The control logic for operating a printing, binder, trimmer apparatus with the lamination station 301, as shown in FIG. 26, will be understood by one of ordinary skill in the art from the following listing of the basic programming steps:

1. CONT 1 determines the number of book block printers 110 or 200 running on the machine.
2. CONT 1 signals (by placing a control file) the book director program on a book server, which black and white book block printer 110 or 200 is ready for a book block file (i.e., the text pages) and if two printers are present, toggles a logical variable to signal the book director program to the second printer for the next book. (And then back to the first printer for the following book and so on.)
3. The book director program sends a pre-defined book "package" consisting of a book block printing script or text with the printer designated by 2 to the print spooler of the selected printer 110 or 200, a cover printing script with the cover printer 114 designated to the print spooler and a control file containing the book finish parameters (e.g., number of pages, paper thickness, any vertical offset between the cover and the book block, and finish trim dimensions).
4. CONT 1, having determined which black and white book block printer is to receive the next book block, positions the carriage 7 proximate to and monitors port #23 of that printer 110, 200 via a tcp/ip connection for a job complete message at that port.
5. Upon receiving the job complete message at the monitored port, controller CONT 1 moves the carriage 7 fully into position at a respective printer 110, 200 to receive the book block BB. As the carriage moves into position, a switch is closed causing the book block tray controller associated with that printer to clamp rotate and then release the book block into the carriage. Upon releasing the book block, the book block tray controller notifies CONT 1 that the block is in place.
6. The laminator controller CONT 5 notifies the cover controller CONT 4 that it is on line. CONT 5 monitors, via sensor LS1, for the presence of a cover C being fed from the cover printer 200 into the cover transfer mechanism 116'.
7. Upon sensing a cover in the cover transfer mechanism 116', CONT 5 starts the input feed rollers 313A, 313B at the same feed rate as the output rate of the cover transfer mechanism 116' rail. When the cover has cleared the cover transport rollers, the input feed rollers than change to the feed speed of the laminator 303.
8. As the cover approaches the laminator, the laminator rolls 309A, 309B and 311A, 311B are energized as well as the pick-off set of rolls 323A, 323B on the delivery of the cover to the laminator.
9. CONT 5 then monitors the movement of the laminated cover via sensor 329 as it approaches the final position on table 321. As the laminated cover reaches the final trim position, the laminator is turned off and the pick-off rollers 323A, 323B and 327A, 327B position the cover precisely (using the sensor 329) such that the center portion CP of the cover is positioned in register at the conditioning station CS for the trimming the cover and laminations upon actuation of trim knives 331 and 335 and for conditioning the central portion of the cover upon actuation of cylinder 349 so as roughen the inner surface of the cover portion CP by discs 355.
10. CONT 5 then actuates the two trim cylinders 333, 339, trimming the cover to its desired length and actuates the roughing cylinder 349 moving the lamination rougher 343 over the spine area (i.e., the central portion CP) of the cover DLC.
11. CONT 5 then moves the conditioned cover further down away from the laminator until the trailing edge of the cover now passes the gravity diverter 325.
12. CONT 5 then reverses the movement of the pick-off rollers 327A, 327B, starts the lower transfer rollers and reverses and starts the input feed rollers 373A, 373B and 375A, 375B.
13. The cover then moves from table 321 through the lower channel 371A, 371 B and back into the cover transfer mechanism 116' .
14. As the cover crosses the input sensor LS1, CONT 5 signals the cover controller CONT 4 that the cover is now back in the transport mechanism 116' and the cover controller is then able to complete its delivery cycle to the binding station BS.
15. As the trailing edge of the cover passes the input sensor LS1, CONT 5 stops all motors and resets itself awaiting the next cover.
16. CONT 1 then monitors the cover printer transfer controller CONT 4 for a signal that it has placed the cover into place in the binder station BS.
17. Upon notification that a book block BB is in place within carriage 7 and that the cover is in place at the binding station BS, CONT 1 then moves carriage 7 to the jogging station JS and reads the control file sent in 3.
18. Using the dimensions T1–T5 incorporated in the control file, as above described, the trim margins TM1–TM3 are determined.

-continued

19. The desired position of the cover DLC at the binding station BS are then determined such that that cover is centered with respect to book block spine S.
20. With carriage 7 positioned at jogging station JS, the jogging station is energized and deenergized for a time sufficient to jog pages P (about 1–3 seconds) so as to align the pages of the book block.
21. During the jogging operation, the trailing edge of book block BB is insured to be in contact with vertical carriage wall 21 thus accurately establishing the fore to aft position of the book block in carriage 7.
22. With the book block BB properly positioned within the carriage, Carriage Clamp Motor M2 is energized so as to close carriage clamps 11a, 11b.
23. Wait 5 seconds, and then energize motors M3–M5.
24. Energize Carriage Stepper Motor M1 to drive carriage 7 from Jogging Station JS to Mill Station MS. As the carriage approaches Mill Station MS, the mill head 31 is energized so as to roughen the spine of the book block as the latter is conveyed past the mill station.
25. As the book block BB is conveyed over adhesive application station AS, the spine of the book block has a suitable amount of hot melt adhesive applied thereto.
26. Deenergize Carriage Stepper motor Ml so as to stop carriage 7 at binding station BS with book block BB positioned over center CP of cover DLC.
27. Energize pump PM4 to raise binding clamp 35.
28. Energize clamp motor M6 to clamp cover on book block. This clamp is maintained for a time sufficient for the setting of adhesive A to bind the spine of the book block BB to the inner surface of the conditioned cover DLC.
29. Energize clamp motor M6 to release book.
30. Reverse operation of pump PM4 to lower binding clamp 35.
31. Energize carriage stepper motor M1 to convey carriage from binding station BS to trim station TS.
32. Energize nest elevator motor M6 to raise nest elevator.
33. Energize carriage clamp motor M2 to drop book.
34. Energize carriage stepper motor M1 to nudge book to predetermined position within nest 41 such that first edge of book is accurately position with respect to nest 41.
35. Energize pump PM3 to actuate nest clamp 57.
36. Energize nest elevator stepper motor to lower nest to predetermined elevation.
37. Energize trim carriage 61 stepper motor M9 to move trimmer 59 toward first edge of book to be trimmed (T3).
38. Deenergize motor M9 to stop trimmer 59 so as to trim first trim margin TM1 from book.
39. Energize Pump PM2 to close shear clamp 67.
40. Energize Pump PM1 to close trimmer blade 64.
41. Reverse operation of Pump PM1 to open trimmer blade 64.
42. Reverse operation of Pump PM2 to open shear clamp 67.
43. Energize trimmer carriage stepper motor M9 to move trimmer carriage clear of book.
44. Energize book indexing stepper motor M9 to rotate book in nest 90° so as to position a second edge of book to be trimmed. (T4).
45. Energize trim carriage 61 stepper motor M9 to move trimmer 59 toward second edge of book to be trimmed.
46. Deenergize motor M9 to stop trimmer 59 so as to trim second trim margin TM1 from book.
47. Energize Pump PM2 to close shear clamp 67.
48. Energize Pump PM1 to close trimmer blade and to trim second edge.
49. Reverse operation of Pump PM1 to open trimmer blade.
50. Reverse operation of Pump PM2 to open shear clamp 67.
51. Energize trimmer carriage stepper motor M9 to move trimmer carriage clear of book.
52. Energize book indexing stepper motor M9 to rotate book in nest 41 90° so as to orient third edge of book to be trimmed toward trimmer.
53. Energize trim carriage 61 stepper motor M9 to move trimmer 59 toward third edge of book to be trimmed.
54. Deenergize motor M9 to stop trimmer 59 so as to trim third trim margin TM1 from book so as to trim book to final height (T5).
55. Energize Pump PM2 to close shear clamp 67.
56. Energize Pump PM1 to close trimmer blade and to trim third edge.
57. Reverse operation of Pump PM1 to open trimmer blade.
58. Reverse operation of Pump PM2 to open shear clamp 67.

-continued

59. Energize trimmer carriage stepper motor M9 to move trimmer carriage clear of book
60. Energize Pump PM to open book clamp 57 and to release book.

The above steps complete the printing of the book block BB and of the cover C, the laminating of the cover C, the binding of the book block to the double laminated cover DLC, and the trimming of a first book. It will be understood that while the first book is being so printed, laminated, bound and trimmed, a second book may be substantially simultaneously be printed by the second text printer 200. Depending on the number of pages in the books being printed, the printing of the text pages of the book block typically determines the length of time necessary to print and bind a book with the apparatus of this invention. Thus, by providing two text page printers, the throughput of the apparatus can be significantly increased.

In view of the above, it will be seen that the several objects and features of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of making a perfect bound book having a book block comprising a multiplicity of paper pages, a double laminated cover having a paper cover, an inner lamination and an outer lamination adhered to the inner and outer faces of said paper cover, said book block having one lateral edge thereof referred to as a spine, said method comprising the steps of:

a. forming said book block;

b. laminating a suitable plastic film to the outer face of said cover so as to constitute said outer lamination;

c. laminating a suitable plastic film to the inner face of said cover so as to constitute said inner lamination, said cover with said inner and outer laminations adhered thereto forming said double laminated cover;

d. after laminating said double laminated cover, roughening at least the surface of a central portion of the inner face of said inner lamination so that said adhesive will effectively bind said spine to said inner lamination in the area of said central portion;

e. applying an adhesive so as to be disposed between said spine and said central portion of the inner face of said double laminated cover upon binding of the book;

f. bringing said central portion of said double laminated cover and said spine of said book block into binding engagement with one another with said adhesive therebetween; and g. clamping said double laminated cover to said book block proximate said spine so that said adhesive adheres said double laminated cover to said spine of said book block.

2. The method of claim 1 wherein said step of roughening said center portion of said double laminated cover comprises forming a multiplicity of cuts in said inner lamination.

3. The method of claim 1 wherein said step of conditioning said central portion comprises scarifying said inner lamination.

4. The method of claim 1 wherein said step of laminating said outer and inner laminations are done simultaneously with one another.

5. The method of claim 2 wherein said step of forming said cuts in said inner lamination results in at least some of said cuts extending through said inner lamination so as to at least in part expose said paper cover to said adhesive.

6. The method of claim 3 wherein said step of scarifying said inner lamination comprises forming a multiplicity of cuts in said inner lamination.

7. The method of claim 6 wherein said step of forming said cuts in said inner lamination includes cutting through said inner lamination and at least partially into said paper cover.

8. The method of claim 7 wherein said step of forming said cuts is performed by forcibly rolling a roller over the inner lamination in the area of said center portion of said double laminated cover, said roller having a plurality of points on its outer periphery with said points forming cuts in said inner.

9. The method of claim 7 wherein as said roller is moved with respect to said center portion with said roller points in contact therewith, said roller is counter-rotated in a direction opposite to the direction it rollingly engages the inner lamination.

10. The method of claim 9 wherein said points at least in part pull portions of said inner lamination out of the plane of said inner lamination thereby to roughen the surface of said inner lamination in the region of said center portion of said double laminated cover.

11. The method of claim 10 wherein said points engage said paper cover and as said points roll out of contact with said paper cover at least in part pull portions of said paper cover out of the plane of said paper cover.

12. The method of claim 10 where by forming said cuts through said inner lamination, said adhesive may directly contact said paper cover in the region of said cuts.

13. A method of printing a book on demand and of perfect binding said book, said book having a book block comprising a plurality of paper text pages, a double laminated cover having an inner face and an outer face and having an outer lamination of plastic film laminated to said outer face of said paper cover and an inner lamination of plastic film laminated to said inner face of said paper cover, said book block having one edge thereof constituting a spine, said method comprising the steps of:

a. printing said text pages corresponding to said book;

b. forming said book block from said text pages;

c. printing said paper cover corresponding to said book being printed on demand;

d. laminating said outer and inner laminations to the inner and outer faces of said paper cover;

e. conditioning at least the surface of a portion of the inner face of said double laminated cover in an area to be adhered to said spine of said book block so as to facilitate adhesive binding of said spine of said book block with said double laminated cover in the area of said central portion, wherein said step of conditioning said portion of said inner cover comprises roughening at least the surface of said portion of said inner lamination of said double laminated cover;

f. applying a suitable adhesive so as to be disposed between said spine of said book block and said portion of said laminated cover to be adhered to said spine;

g. bringing said spine and said conditioned portion of said double laminated cover into adhesive binding relation so that said adhesive adheres directly to said conditioned portion of said cover; and h. clamping said double laminated cover to said book block proximate said spine for a time sufficient to effect binding of said book block to said cover so as to form a perfect bound book having a double laminated cover.

14. The method of claim 13 wherein said step of roughening said conditioned portion of said double laminated cover comprises scarifying said inner lamination.

15. The method of claim 13 wherein said step of roughening said conditioned portion of said double laminated cover comprises forcibly rolling a roller over said inner lamination wherein said roller has a plurality of points thereon which penetrate at least in part into said inner lamination.

16. The method of claim 15 wherein said roller is counter rotated as said roller is forcibly rolled over said cover.

17. The method of claim 16 wherein said points on said roller form a multiplicity of cuts in said inner lamination.

18. The method of claim 17 wherein upon forming said cuts, said points of said roller pail portions of said inner lamination in the region of said cuts out of the plane of said inner lamination thereby roughening said surface of said inner lamination.

19. The method of claim 18 wherein said points of said roller penetrate through said inner lamination exposing said paper cover to said adhesive.

20. The method of claim 18 wherein said points of said roller penetrate at least in part into said paper cover and pull at least portions of said paper cover out of the plane of said paper cover into said cuts.

21. Apparatus for printing a perfect bound book on demand, said book comprising a book block having a multiplicity of paper pages, one edge of said book block constituting a spine, a soft paper cover, said cover having an outer face and an inner face, said cover having an outer lamination adhered thereto and said inner face of said cover having an inner lamination adhered thereto, said inner face of said cover having a central portion adhesively bonded to said spine, said apparatus comprising:

a. a text printer for printing on demand the text pages comprising said book block;

b. a cover printer for printing on demand said cover for said on demand printed book;

c. a lamination station for laminating a plastic film to both the outer face and the inner face of said cover thus forming a double laminated cover;

d. a cover conveyor conveying said cover from said cover printer to said lamination station;

e. a carriage receiving said book block after said text pages have been printed by said text printer;

f. said carriage transporting said book block along a work path from a receiving station in which said carriage receives said book block to an adhesive application station in which an adhesive is applied to said spine of said book block;

g. said carriage transporting said book block from said adhesive application station to a binding station;

h. said cover conveyor transporting said double laminated cover from said lamination station to a cover conditioning station;

i. said cover conditioning station conditioning a portion of the inner face of said double laminated cover so as to facilitate the adhesive binding of said double laminated cover to said spine of said book block;

j. said laminated cover conveyor transporting said double laminated cover to said binding stations such that said conditioned portion of said double laminated cover is substantially in register with said spine; and k. said binding station having a binding clamp engageable with the outer face of said double laminated cover proximate said spine so as to forcibly clamp said double laminated cover to said book block with said spine being substantially in register with said conditioned portion whereby said adhesive binds said double laminated cover to said spine.

22. Apparatus as set forth in claim 21 wherein said conditioning station comprises a roller movable transversely with respect to the direction of transport of said cover, said roller having a plurality of points thereon scarifying inner lamination of said conditioned portion as said roller rolls thereover.

23. Apparatus as set forth in claim 22 wherein said roller has a plurality of points thereon which at least in part penetrate into said inner lamination.

24. Apparatus as set forth in claim 23 wherein said roller is counter rotated as said roller engages said conditioned portion thereby to form a plurality of slits or cuts in said inner lamination.

25. Apparatus as set forth in claim 24 wherein said conditioning station comprises a holder for rotatably mounting said roller, said holder being movable transversely across said cover, a friction wheel carried by said holder rollingly engageable with said cover as said holder is moved transversely across said cover, said friction wheel driving a gear in mesh with a pinion affixed to said roller for counter-rotating said roller as said holder is moved with respect to said cover.

* * * * *